US005732314A

United States Patent [19]

Tsukida et al.

[11] Patent Number: 5,732,314

[45] Date of Patent: Mar. 24, 1998

[54] IMAGE FORMING APPARATUS COMPRISING IMAGE BEARING MEMBER, INTERMEDIATE IMAGE TRANSFER MEMBER AND SECONDARY IMAGE TRANSFER MEMBER FOR FACILITATING TRANSFER OF DEVELOPED IMAGE FROM INTERMEDIATE IMAGE TRANSFER MEMBER TO TRANSFER MATERIAL

[75] Inventors: Shinichi Tsukida, Yono; Koichi Tanigawa, Tokyo; Masahiro Goto; Toshio Miyamoto, both of Yokohama; Yuko Ohkama, Tokyo; Satoru Izawa; Yozo Hotta, both of Yokohama, all of Japan

[73] Assignee: Canon Kabushiki Kaisha, Tokyo, Japan

[21] Appl. No.: 346,921

[22] Filed: Nov. 23, 1994

[30] Foreign Application Priority Data

Nov. 26, 1993 [JP] Japan ..... 5-321403
Nov. 26, 1993 [JP] Japan ..... 5-321404

[51] Int. Cl.[6] ..... G03L 15/00; G03L 15/01; G03L 15/14

[52] U.S. Cl. ..... 399/302; 399/308

[58] Field of Search ..... 355/271, 272, 355/274, 275, 277, 326 R, 327; 430/126; 399/302, 308

[56] References Cited

U.S. PATENT DOCUMENTS

| | | | |
|---|---|---|---|
| 4,910,558 | 3/1990 | Giezeman et al. | 355/279 |
| 5,010,370 | 4/1991 | Araya et al. | 355/274 |
| 5,066,979 | 11/1991 | Goto et al. | 355/208 |
| 5,084,735 | 1/1992 | Rimai et al. | 355/271 |
| 5,172,173 | 12/1992 | Goto et al. | 355/275 |
| 5,187,526 | 2/1993 | Zaretsky | 355/273 |
| 5,291,254 | 3/1994 | Shimada et al. | 355/275 |
| 5,438,398 | 8/1995 | Tanigawa et al. | 355/271 |

FOREIGN PATENT DOCUMENTS 5-333735 12/1993 Japan .

*Primary Examiner*—Joan H. Pendegrass
*Attorney, Agent, or Firm*—Fitzpatrick, Cella, Harper & Scinto

[57] ABSTRACT

An image forming apparatus including an image bearing member for bearing an image thereon, an intermediate transfer member having a base body and an elastic member provided outside the base body and onto which an image is transferrable from the image bearing member, and a second transfer member forming a nip portion between the second transfer member and the intermediate transfer member, for transferring an image from the intermediate transfer member to a transfer material in the nip portion. The hardness of the surface of the second transfer member is greater than the hardness of the surface of the intermediate transfer member.

28 Claims, 10 Drawing Sheets

IMAGE FORMING APPARATUS COMPRISING IMAGE BEARING MEMBER, INTERMEDIATE IMAGE TRANSFER MEMBER AND SECONDARY IMAGE TRANSFER MEMBER FOR FACILITATING TRANSFER OF DEVELOPED IMAGE FROM INTERMEDIATE IMAGE TRANSFER MEMBER TO TRANSFER MATERIAL

BACKGROUND OF THE INVENTION

1. Field of the Invention

This invention relates to an image forming apparatus for transferring an image on a first image bearing member to an intermediate transfer member as a second image bearing member, and thereafter transferring the image from the intermediate transfer member to a transfer material.

2. Related Background Art

An image forming apparatus using an intermediate transfer member as described above repeats the steps of forming a transferrable image on a first image bearing member and the primary transferring of the image to the intermediate transfer member to thereby form a color image (or a polychromatic image) comprising a plurality of color developers on the intermediate transfer member, and thereafter secondary-transferring the images collectively to a sheet. Thus, the image forming apparatus is effective as an apparatus for outputting a formed image which has compositely reproduced color image information, or an image forming apparatus provided with a color image forming function, and can provide for an image free of color misregistration of respective component color images.

As a full color image forming apparatus using an intermediate transfer member, it is known to use a drum-shaped roller member as an intermediate transfer member, as described in U.S. Pat. No. 5,187,526. FIG. 11 of the accompanying drawings schematically shows the construction of that image forming apparatus.

In accordance with the well-known electrophotographic method, an electrophotographic photosensitive drum (a first image bearing member) 1 rotatively driven in a counterclockwise direction is uniformly charged by a charger 2, and an electrostatic latent image obtained by exposure 3 is visualized by imparting a developer (hereinafter referred to as the "toner") comprising charged coloring particles to the electrostatic latent image by a developing device 4. The toner image is primary-transferred to an intermediate transfer roller (a second image bearing member) 5 which is in contact with or closely adjacent to the photosensitive drum 1 and is synchronously rotated in a forward direction at the same peripheral speed as the photosensitive drum 1, in a first transfer nip area N1. The intermediate transfer roller 5 is comprised of a mandrel 51 and a surface layer 52 comprising a thin layer of electrically conductive polyurethane. A bias voltage of polarity opposite the toner is applied thereto by a voltage source 6 to thereby electrostatically transfer the toner image from the photosensitive drum 1.

The step of forming the toner image on the photosensitive drum 1 and the step of primary transferring the toner image to the intermediate transfer roller are repetitively executed a number of times corresponding to the number of necessary component colors of desired full color image information, whereby a full color image corresponding to the desired color image information is compositely formed on the surface of the intermediate transfer roller 5 by the superposed tranfer of respective component color toner images. As regards the developing device 4, a developing device containing a toner of corresponding color therein is placed at the developing position for the photosensitive drum 1 a time each component color toner image is to be formed on the photosensitive drum 1.

When the primary transfer of the last toner image from the photosensitive drum 1 to the intermediate transfer roller 5 is executed, a sheet 10 such as transfer paper is fed at predetermined timing from a sheet supply portion to the second transfer nip area N2 between the intermediate transfer roller 5 and a transfer roller 7 which acts as a contact transfer member. The superposed color images formed on the intermediate transfer roller 5 are secondary-transferred collectively to the sheet 10.

The tranfer roller 7 is comprised of a mandrel 71 and a surface layer 72 thereon comprising a thin layer of electrically conductive polyurethane. The mandrel 71 is coupled to ground 82 by a switch 9 during the primary transfer of the toner images from the photosensitive drum 1 to the intermediate transfer roller 5. During the secondary transfer of the superposed color images from the intermediate transfer roller 5 to the sheet 10, the mandrel 71 is coupled to a bias voltage source 81 having a voltage opposite in polarity to the toner and greater than the voltage applied from the voltage source 6 to the mandrel 51 of the intermediate transfer roller 5. The sheet 10 to which the superposed color images have been transferred from the intermediate transfer roller 5 is introduced into a fixing device, whereby it is subjected to an image fixing process to thereby provide a full color image.

Reference numeral 12 designates a cleaner for the photosensitive drum 1. Reference numeral 11 denotes a cleaner for the intermediate transfer roller 5. The cleaner 11 is moved toward and away from the intermediate transfer roller 5 by shifting means, and is held at a position spaced apart from the intermediate transfer roller 5 at least during the time from after the primary transfer of the toner image from the photosensitive drum 1 to the intermediate transfer roller 5 is started until the secondary transfer of the superposed color images from the intermediate transfer roller 5 to the sheet 10 is terminated. It should be noted that the transfer roller 7 may also be movable toward and away from the intermediate transfer roller 5 by shifting means so that it may be held in a pressure-contact position with the intermediate transfer roller 5 during the secondary transfer of the superposed color images from the intermediate transfer roller 5 to the sheet 10.

The use of the drum-shaped intermediate transfer roller 5 as an intermediate transfer member as in the above-described apparatus, as compared with the use of a belt-shaped intermediate transfer member, does not require a running accuracy correcting mechanism. This leads to an advantage that a full color image free of color misregistration can be obtained by a simple construction, as is disclosed in Applicant's Japanese Patent Application No. 5-164226. According to the above-mentioned U.S. Pat. No. 5,187,526, the electrical resistivity of the intermediate transfer roller 5 is made less than $10^{9}\Omega\cdot$cm and the electrical resistivity of the transfer roller 7 is made greater than $10^{10}\Omega\cdot$cm, whereby a good image can be obtained.

Regarding the surface layers 52 and 72 of the intermediate transfer roller 5 and the transer roller 7, respectively, the above-mentioned U.S. Pat. No. 5,187,526 only describes that both of them are a thin layer, and mentions no physical condition except that their base material is polyurethane. However, in the above-described example of the prior art, to give a sufficient transfer charge to the sheet 10 during the secondary transfer of the superposed color visible images from the intermediate transfer roller 5 to the sheet 10, it has been found that the output voltage value of the voltage source 81 must be made large. This leads to the inconvenience that the surface layer 72 formed of polyurethane having an electrical conductivity imparting agent dispersed therein creates a localized breakdown and causing a disturbance in the image pattern in which toner is sparsely distributed, creating half-tone like images.

Thus, if an attempt is made to realize the transfer current 4 μA shown in U.S. Pat. No. 5,187,526 in the surface layer 72 having a volume resistivity of $10^{10}\Omega\cdot$cm or greater, assuming that the thickness of the surface layer 72 is 5 mm, and in the parameter of the transfer roller 7 usually used in a compact image forming apparatus in which the nip width of the second transfer nip area N2 is 2 mm and the lengthwise dimension of the nip is 200 mm, a voltage of 5 KV is required when the intervention of the sheet 10 is not taken into account. A voltage as high as 10 KV is required when it is also taken into account that the electrical resistivity of the sheet 10 is of the order of $10^9\Omega$.

At such a high voltage, under a high humidity environment in which the atmospheric humidity exceeds 60% RH, the sheet 10 itself may become lower in resistance and the transfer current may leak to a grounded metal plate near the sheet 10 to cause unsatisfactory transfer. Under a low humidity environment in which the atmospheric humidity is below 40% RH, partial breakdown may be caused by the irregularity of the resistance of the sheet 10 to thereby cause the irregularity of transfer.

Further, the transfer roller 7 is ten or more times higher in volume resistivity than the intermediate transfer roller 5, and this leads to the inconvenience that the sheet 10 is liable to be electrostatically attracted to the intermediate transfer roller 5 side. Thus the sheet 10 having left the second transfer nip area N2 twines around the intermediate transfer roller 5. That is, as shown in FIG. 12 of the accompanying drawings, the sheet 10 which is an insulating material becomes polarized by a transfer electric field and is attracted to the intermediate transfer roller 5 and the transfer roller 7, but because of the different magnitudes of electrical resistivity, the intermediate transfer roller 5 becomes a substantially closer electrode and acts to attract the sheet 10. Actually, transfer charges (plus) are imparted to the back of the sheet 10 (the surface thereof opposed to the transfer roller) and under the above-described transfer electric field, in addition to the above-mentioned polarizing effect, the sheet 10 is further attracted toward the intermediate transfer roller 5 side.

In addition, U.S. Pat. No. 5,084,735 which also discloses an image forming apparatus using in intermediate transfer roller 5 bears the statement that the Young's modulus of the intermediate transfer roller 5 exceeds $5\times10^7$ Newtons/m$^2$. In the intermediate transfer roller of Young's modulus exceeding $5\times10^7$ Newtons/m$^2$ disclosed in U.S. Pat. No. 5,084,735, it has been found that because its own hardness is high, even if as described in U.S. Pat. No. 5,187,526, an attempt is made to make the transfer roller harder than the intermediate transfer roller and urge it strongly against the latter to thereby curl the sheet and prevent the twining thereof, the two rollers are too hard and the second transfer area N2 of a sufficient nip width is not provided and the color image to be transferred is crushed to thereby cause the inconvenience of unsatisfactory transfer. Particularly, toner images closer to the surface of the intermediate transfer roller such as first and second color images have been liable to remain on the surface of the intermediate transfer roller, thereby causing an irregularity of color taste which means that the color taste of the color image formed on the surface of the transfer material partly differs. That is, there is a problem that the sheet 10 is liable to twine around the intermediate transfer roller 5 of high hardness and medium resistance. This is liable to arise particularly in a low humidity environment wherein the sheet 10 becomes higher in resistance.

It has been found that when the intermediate transfer member is to be urged against an image bearing member of high hardness like a photosensitive drum, which does not require a rotation accuracy correcting mechanism and enables color misregistration to be prevented by a simple construction, the intermediate transfer member also of high hardness is urged against the surface of the photosensitive drum of high hardness formed of aluminum of a thickness of several millimeters as a base material. Therefore the nip width therebetween (the nip width of a first transfer region 106*a*) becomes considerably narrow and even if the voltage applied to the intermediate transfer member when electrostatically effecting primary transfer is heightened, it remains difficult to obtain sufficient transfer efficiency.

SUMMARY OF THE INVENTION

It is an object of the present invention to provide an image forming apparatus which effects good image transfer from an intermediate transfer member to a transfer material.

It is another object of the present invention to provide an image forming apparatus in which the twining of the transfer material around the intermediate transfer member is prevented.

It is still another object of the present invention to provide an image forming apparatus in which a small voltage can be applied to a second transfer member when image transfer is effected from the intermediate transfer member to the transfer material in the nip portion between the intermediate transfer member and the second transfer member.

It is yet another object of the present invention to provide an image forming apparatus which improves the transfer efficiency from an image bearing member to the intermediate transfer member.

Further objects and features of the present invention will become apparent from the following detailed description taken in conjunction with the accompanying drawings.

DESCRIPTION OF THE PREFERRED EMBODIMENTS

Some embodiments of the present invention will hereafter be described with reference to the drawings.

Figure 1:
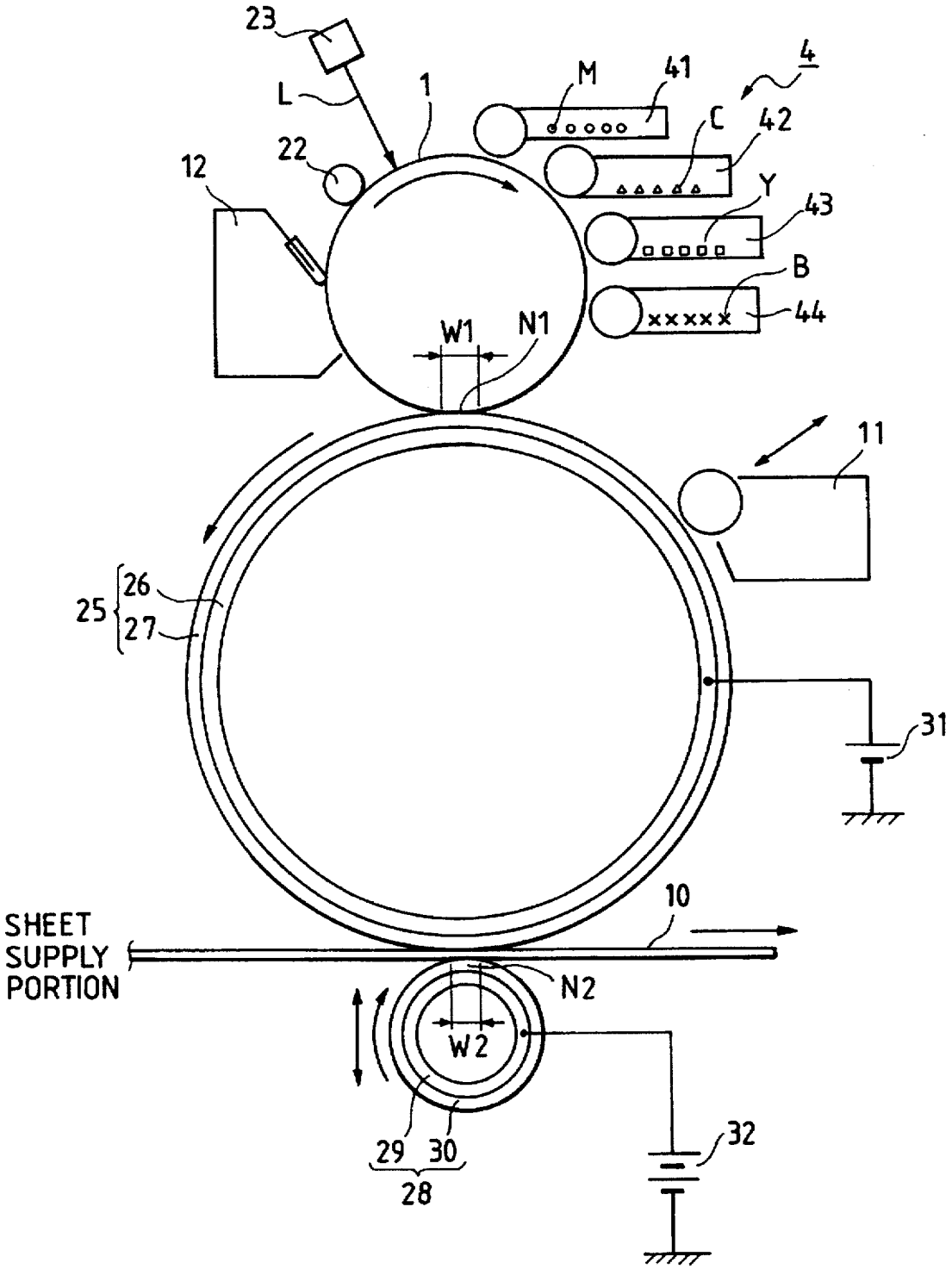
FIG. 1 schematically shows the construction of an image forming apparatus according to a first embodiment of the present invention.
Figure 2:
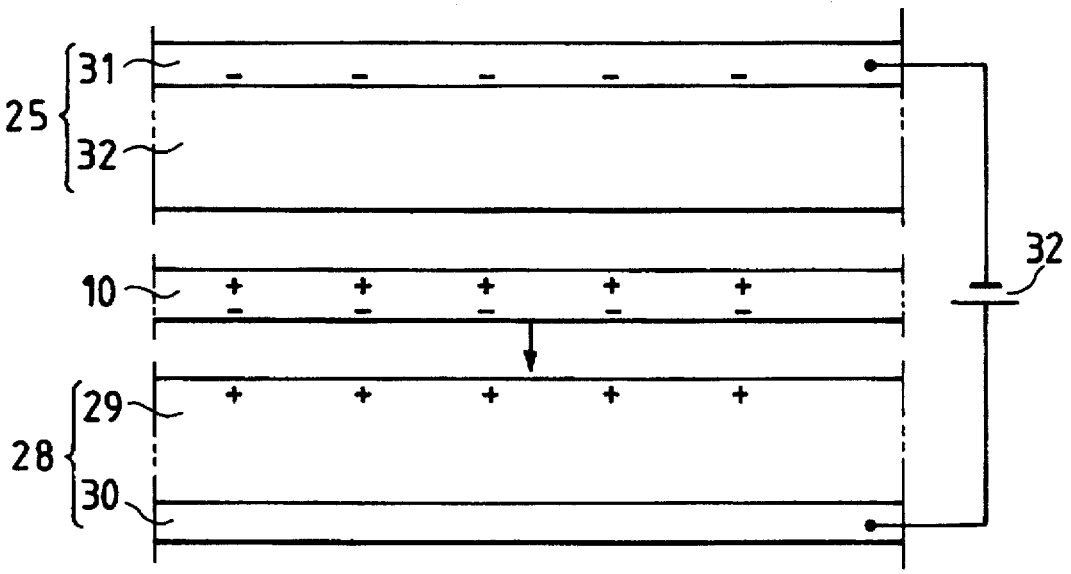
FIG. 2 is a model diagram of charge distribution in a second transfer nip area.

<First Embodiment> (FIGS. 1 and 2)

FIG. 1 schematically shows the construction of an image forming apparatus according to a first embodiment of the present invention. The constituent members and portions of this apparatus which are common to those of the aforementioned apparatus of FIG. 11 are given the same reference characters and need not be described again.

The photosensitive drum 1 comprises a mandrel and an organic photoconductive material (OPC) applied thereto, is rotated in a clockwise direction at a process speed (peripheral speed) of 100 mm/sec. and is uniformly charged to a surface potential of about −600 V by a charger 22 (in the present embodiment, a charging roller rotated in contact therewith). Exposure L is executed by turning on and off laser light scanned in a direction perpendicular to the plane of the drawing sheet of FIG. 1 by the rotatable mirror of a laser scanner 23, in conformity with digital image information, whereby an electrostatic latent image having a dark portion potential of about −600 V and a light portion potential (a portion to which the light is applied) of about −100 V is formed on the photosensitive drum 1.

The developing device 4 comprises four color developing devices 41, 42, 43, and 44 containing therein toners of magenta M, cyan C, yellow Y and black B, respectively, and selectively performs developing operations in succession on the photosensitive drum 1. The developer in each developing device is a non-magnetic one-component developer having a weight average particle diameter of 5–15 μm, an area average weight of 0.5 to 2 mg/cm$^2$, and an inherent charge amount of −10 μc/gr to −30 μc/gr at minus polarity. The developer develops or visualizes the electrostatic latent image by a reverse development process in which the non-magnetic toner adheres to that portion of the photosensitive drum 1 which has been subjected to exposure.

Figure 11:
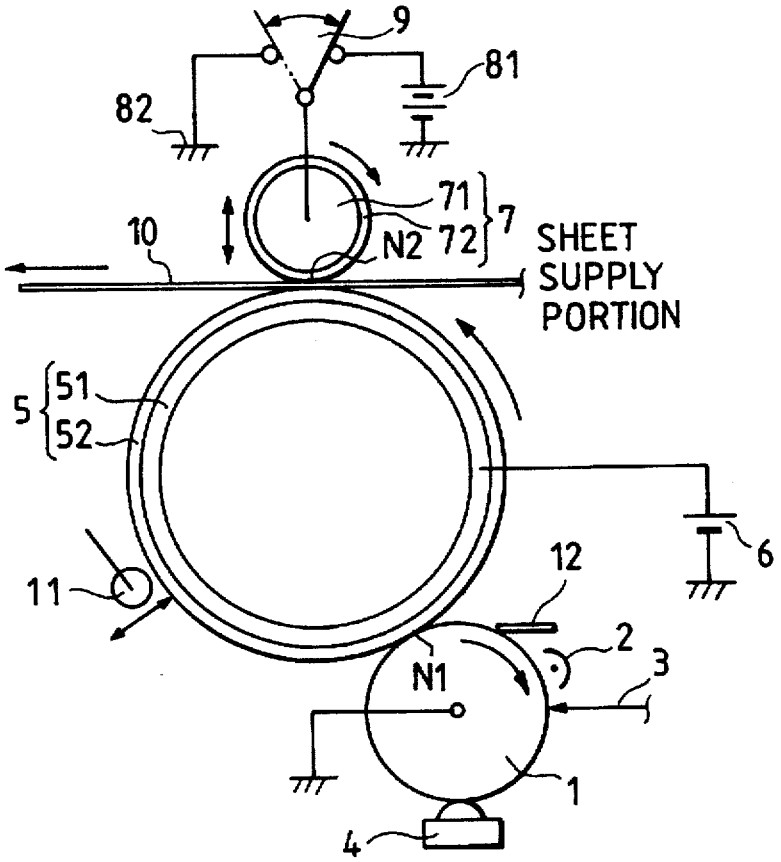
FIG. 11 schematically shows the construction of an apparatus according to the prior art.

The formation of each color component toner image on the photosensitive drum 1 and the formation of a full color image by primary-transferring those color component toner images in succession to an intermediate transfer roller 25 and superposing the toner images of four colors on the intermediate transfer roller 25 are the same as in the aforementioned apparatus of FIG. 11. Any untransferred toners on the photosensitive drum 1 are wiped off by the cleaner 12 and the photosensitive drum 1 is repetitively used for subsequent image formation.

The intermediate transfer roller 25 is a roller of effective length L=250 mm having a peripheral length somewhat greater than the length of the sheet 10 in the direction of conveyance, and comprises a base member 26 and an elastic layer 27. The intermediate transfer roller is provided by forming, on a pipe-like base member 26 of wall thickness 3 mm formed of aluminum, an elastic layer 27 of thickness $t_1$=5 mm and hardness 35 degrees (JIS A) having an electrical conductivity imparting agent such as carbon, zinc oxide, tin oxide, or electrically conductive whisker dispersed in NBR rubber and having its volume resistivity $\rho_1$ adjusted to about $10^9\Omega\cdot$cm to thereby make a diameter of 150 mm. The intermediate transfer roller is driven in a counterclockwise direction at the same process speed (100 mm/sec.) as the photosensitive drum 1. The photosensitive drum 1 and the intermediate transfer roller 25 are urged against each other with a total pressure of 500 gr weight, and a first transfer nip area N1 has a width $w_1$ of about 2 mm. That is, in the first transfer nip area N1, the resistance $R_1$ of the intermediate transfer roller 25 has the following value:

$$R_1 = \rho_1 \times (t_1/L \times w_1) = 10^8\ [\Omega]$$

In the first transfer nip area N1, the preferred transfer current amount is about 5 μA, provided by supplying +500 V from a voltage source 31 to the mandrel 26.

A transfer roller 28 is provided by forming, on a mandrel 29 of diameter 20 mm comprising an iron pipe, an elastic layer 30 of thickness $t_2$=5 mm and an ASKER C hardness of 30 degrees having an electrical conductivity imparting agent such as carbon, zinc oxide, tin oxide, or electrically conductive whisker dispersed in EPDM foamed material and having its volume resistivity $\rho_2$ adjusted to about $10^6\Omega\cdot$cm to thereby make a diameter of 30 mm. The transfer roller 28 is driven in a clockwise direction at the same process speed (100 mm/sec.) as the intermediate transfer roller 25. The intermediate transfer roller 25 and the transfer roller 28 are urged against each other with a total pressure of 800 gr weight. A second transfer nip area N2 has a width $w_2$ of about 3 mm.

That is, the resistance $R_{21}$ of the intermediate transfer roller 25 and the resistance $R_{22}$ of the transfer roller 28 in the second transfer nip area N2 assume the following values:

$$R_{21} = \rho_1 \times (t_1/L \times w_1) = 7 \times 10^7\ [\Omega]$$

$$R_{22} = \rho_2 \times (t_2/L \times w_2) = 7 \times 10^4\ [\Omega]$$

Plain paper used as the sheet 10 has a thickness $t_3$=100 μm and a volume resistivity $\rho_3$ of about $10^{11}\Omega\cdot$cm, and the resistance $R_3$ of the sheet 10 in the second transfer nip area N2 is as follows:

$$R_3 = \rho_3 \times (t_3/L \times w_2) = 1 \times 10^8\ [\Omega]$$

Accordingly, to obtain the preferred transfer current value $I_2$=5 μA in the second transfer nip area N2, $$V = (R_{21} + R_{22} + R_3) \times I_2 = 850\ [V]$$

can be applied to the mandrel 29 of the transfer roller 28 by a voltage source 32. 850 V corresponds to the value when the mandrel 26 of the intermediate transfer roller 25 is grounded. When, as described above, the mandrel 26 is biased to 500 V, 500+850=1350 [V] can be applied to the mandrel 29.

Any untransferred toners on the intermediate transfer roller 25 remaining after the secondary transfer of a full color image from the intermediate transfer roller 25 to the sheet 10 are wiped off by the fur brush cleaner 11 and the intermediate transfer roller 25 is repetitively used for subsequent image formation. It should be noted that the fur brush cleaner 11 and the transfer roller 28 are kept in non-contact with the intermediate transfer roller 25 by shifting means except during their operation so as not to disturb the visualized color images on the intermediate transfer roller 25.

By making the resistance $R_{22}$ of the transfer roller 28 smaller than the resistance $R_{21}$ of the intermediate transfer roller 25, the voltage applied to the transfer roller 28 can be made smaller than in the example of the prior art and therefore, localized breakdown of the sheet 10, the transfer roller 28, and the intermediate transfer roller 25 does not occur and good transfer performance is obtained even under a high humidity/low humidity environment. Because of the necessity of preventing the disturbance of visualized images during the reversing development process, it is preferable that the resistance $R_{21}$ of the intermediate transfer roller 25 be made into a medium resistance of $10^7$ to $10^{10}\Omega$ by supplying substantially the same current value also to the contrast of the dark portion potential −600 V and the light portion potential −100 V on the photosensitive drum 1. However, on the intermediate transfer roller 25, there is no potential contrast of the image portion and the non-image portion like that on the photosensitive drum 1. Therefore even if the resistance $R_{22}$ of the transfer roller 28 is a low resistance of $10^3$ to $10^6\Omega$, no image disturbance will occur. Accordingly, the resistance of the transfer roller 28 should preferably be smaller than $10^6\Omega$.

It is desirable to design the voltage source 32 so as to impart a constant current value as a constant current characteristic even if the resistance $R_3$ of the sheet 10 varies.

The result of the test of the transfer performance carried out with the electrical resistivity $\rho_1$ of the intermediate transfer roller 25 and the electrical resistivity $\rho_2$ of the transfer roller 28 in the above-described embodiment with different values is shown in Table 1 below.

TABLE 1 units: $\rho[\Omega \cdot cm]$ $R[\Omega]$

| | | $\rho_1$ | | | | | |
|---|---|---|---|---|---|---|---|
| | | $10^5$ | $10^6$ | $10^7$ | $10^8$ | $10^9$ | $10^{10}$ |
| | | $R_{21}$ | | | | | |
| $\rho_2$ | $R_{22}$ | $10^4$ | $10^5$ | $10^6$ | $10^7$ | $10^8$ | $10^9$ |
| $10^5$ | $7 \times 10^3$ | $NG_1$ | $NG_1$ | Δ | OK | OK | OK |
| $10^6$ | $7 \times 10^4$ | $NG_1$ | $NG_1$ | Δ | OK | OK | OK |
| $10^7$ | $7 \times 10^5$ | $NG_1$ | $NG_1$ | Δ | OK | OK | OK |
| $10^8$ | $7 \times 10^6$ | $NG_1$ | $NG_1$ | $NG_2$ | Δ | OK | OK |
| $10^9$ | $7 \times 10^7$ | $NG_1$ | $NG_1$ | $NG_2$ | $NG_2$ | Δ | Δ |
| $10^{10}$ | $7 \times 10^8$ | $NG_1$ | $NG_1$ | $NG_2$ | $NG_2$ | $NG_2$ | $NG_2$ |

In Table 1, $NG_1$ means that the images are disturbed during primary transfer, and $NG_2$ means that the images are disturbed during secondary transfer. Δ means that the result is OK under ordinary use conditions, but the disturbance of the images occurs when the resistance $R_3$ of the sheet 10 is a high resistance, that is, when both-surface color printing is effected on a sheet left under a low humidity environment condition for a long period or on the back of a sheet once passed through a heat fixing device.

The disturbance of the images during secondary transfer, as described with respect to the example of the prior art, is due to unsatisfactory transfer caused by localized breakdown or twining of the sheet 10 around the intermediate transfer roller 25. In the "OK" or "Δ" areas in Table 1, the twining of the sheet 10 has not occurred. Putting these together, a good transfer performance can be obtained when the resistance $R_{22}$ of the transfer roller 28 is smaller than the resistance $R_{21}$ of the intermediate transfer roller 25 and the resistance $R_{21}$ of the intermediate transfer roller 25 is in a medium resistance range of $10^6$ to $10^9\Omega$.

In the above-described embodiment, the elastic layer 30 of the transfer roller 28 is a foamed material, but alternatively, a construction may be adopted in which this layer is made into a solid-state elastic layer of urethane rubber, silicone rubber, fluorine rubber, or the like and the surface thereof is made into a uniform surface having little unevenness and is normally caused to bear against the intermediate transfer roller 25. During primary transfer, a bias voltage of the same polarity as the toners is applied to the mandrel 29 to thereby prevent the transfer of the toners from the intermediate transfer roller 25 to the transfer roller 28.

Figure 12:
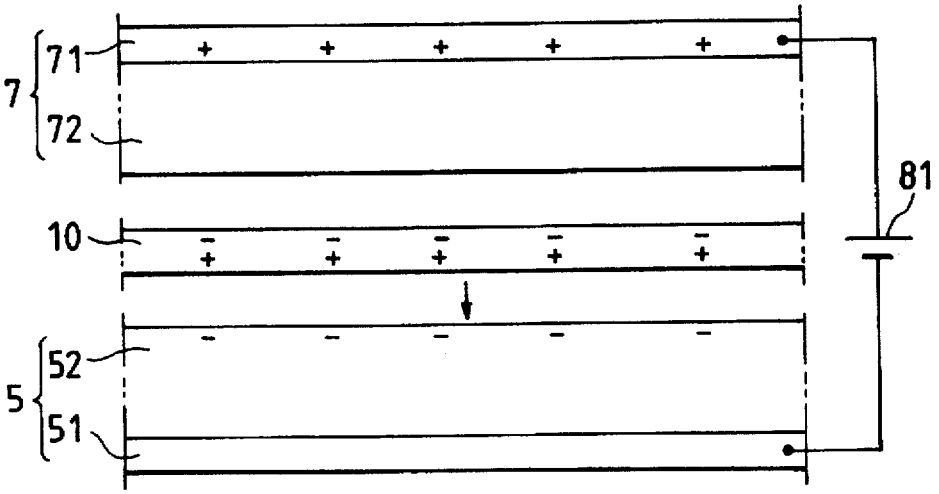
FIG. 12 is a model diagram of charge distribution in a second transfer nip area.

FIG. 2 is a model diagram of the charge arrangement in the second transfer nip area N2 in the present embodiment. Unlike the example of the prior art shown in FIGS. 11 and 12, here the second transfer roller 28 provides an electrode nearer to the sheet 10 and the dielectrically polarized sheet 10 is attracted to the transfer roller 28 side. Also, to prevent the twining of the sheet 10 around the intermediate transfer roller 25, it is preferable to dispose the intermediate transfer roller 25 above and the second transfer roller 28 below so that the direction in which gravity acts on the sheet 10 may be toward the second transfer roller 28 side.

Figure 3:
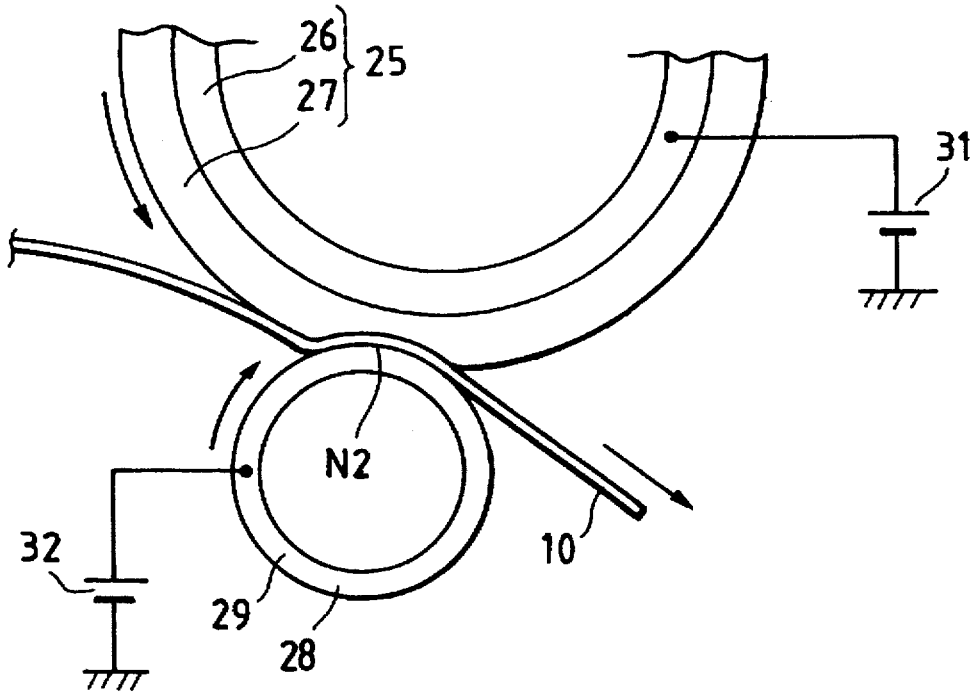
FIG. 3 is a model view of the essential portions of an image forming apparatus according to a second embodiment of the present invention.

<Second Embodiment> (FIG. 3)

FIG. 3 is a model view of the essential portions of an image forming apparatus according to a second embodiment of the present invention. This embodiment is similar to the first embodiment except for the apparatus construction and image forming operation which will hereinafter be described.

The intermediate transfer roller 25 is a roller of medium resistance like that in the first embodiment. The second transfer roller 28 is a roller of diameter 30 mm comprising an aluminum pipe having its surface finished into a mirror surface, and unlike the transfer roller 28 in the first embodiment, it does not have the elastic layer 30 having an electrical conductivity imparting material dispersed therein on the surface portion thereof, and is designed such that the mandrel 29 directly contacts the back of the sheet 10. The resistance value $R_{22}$ of this metallic roller is $10^0$ to $10^2\Omega$ which is lower than the resistance of the intermediate transfer roller 25 of medium resistance. Further, the resistance is uniform and there is no breakdown by the non-uniform dispersion of the electrically conductive material and thus, a good transfer performance and the prevention of twining of the sheet 10 around the intermediate transfer roller 25 can be obtained.

Further, relative to the hardness (JIS A) 35 degrees of the intermediate transfer roller 25, the second transfer roller 28 is formed of aluminum and is a rigid member with Young's modulus $1.0\times10^{11}N\cdot m^{-2}$ and is sufficiently hard compared with the intermediate transfer roller 25 whose Young's modulus converted value is $1.6\times10^{4}N\cdot m^{-2}$. Accordingly, when the transfer roller 28 is urged against the intermediate transfer roller 25 With total pressure 800 gr weight, the surface layer 27 of the intermediate transfer roller 25 is deformed into a concave shape as shown, whereby the second transfer nip area N2 is formed, and the sheet 10 is conveyed along this nip shape, so that the sheet 10 does not twine around the intermediate transfer roller 25, when coupled with the electrostatic attracting effect of the transfer roller 28.

To prevent the twining of the sheet 10 around the intermediate transfer roller 25, it is preferable to dispose the second transfer roller 28 upstream of the lowest point of the intermediate transfer roller 25 with respect to the direction of movement of the intermediate transfer roller so that the sheet 10 may pass through the seocnd; transfer nip along the intermediate transfer roller 25 and by the utilization of the rigidity of the sheet 10, the leading end of the sheet 10 after discharged from the second transfer nip area may move away from the intermediate transfer roller 25.

Figure 4:
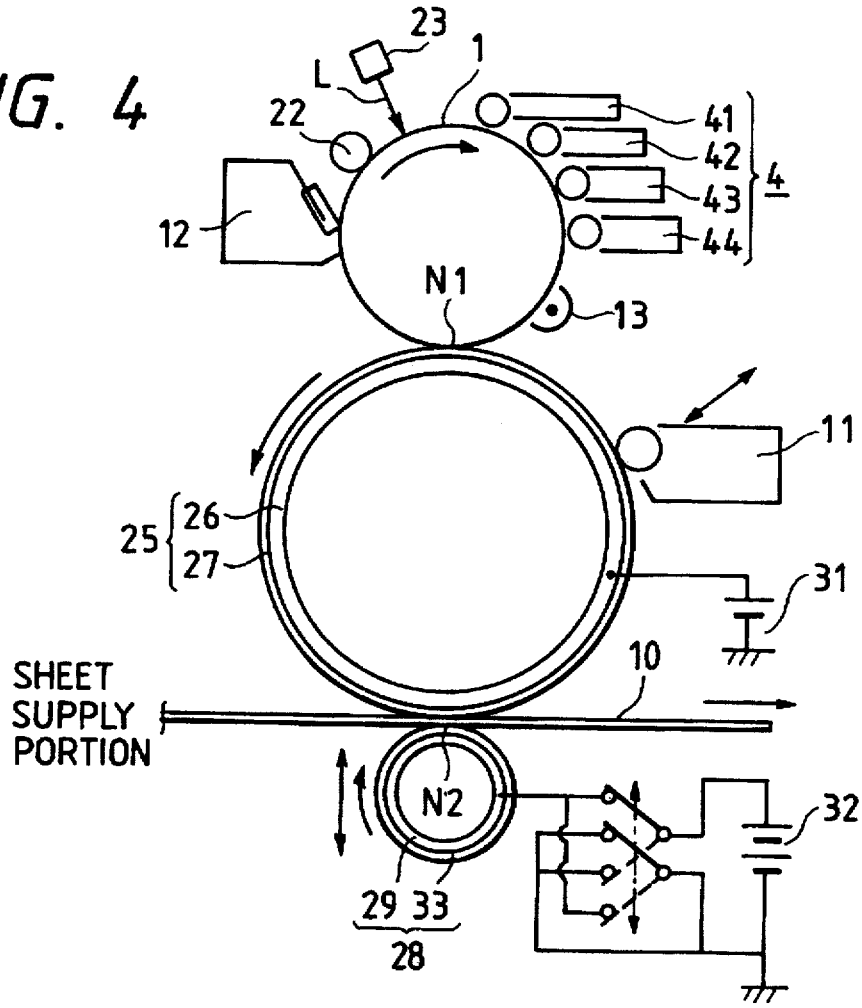
FIG. 4 schematically shows the construction of an image forming apparatus according to a third embodiment of the present invention.

<Third Embodiment> (FIG. 4)

FIG. 4 schematically shows the construction of an image forming apparatus according to a third embodiment of the present invention. In this embodiment, constituent members and portions common to those of the apparatus of FIG. 1 are given the same reference characters and need not be described again.

The reference numeral 13 designates a precharger for reducing the difference between the dark portion and the light portion of the surface potential of the photosensitive drum 1 prior to the primary transfer of the toner images from the photosensitive drum 1 to the intermediate transfer roller 25. The precharger 13, for example, decreases the potential difference of 500 V between the light portion and the dark portion of the drum 1 it within 200 V. When the potential on the photosensitive drum 1 is thus made uniform, the difference between the light portion and the dark portion of the transfer current during primary transfer becomes small. Therefore even if the resistance $R_{21}$ of the surface layer 27 of the intermediate transfer roller 25 is $10^3$ to $10^5\Omega$, the disturbance of the images during transfer will not occur.

The precharger 13 may be of a suitable construction such as one using minus corona discharge to minus-charge so as to approximate the light portion potential to the dark portion potential, or one which removes charges by AC corona discharge. Also, instead of using the precharger 13, it can be arbitrarily set to thereby reduce the contrast of the light portion and the dark portion.

The second transfer roller 28 comprises an aluminum mandrel 29 and a PFA (parfluoroalkoxy) tube 33 of thickness 50 μm having carbon dispersed therein and having electrical conductivity imparted thereto, the PFA tube 33 being adhesively secured onto the aluminum mandrel 29 to thereby provide an outer diameter of 30 mm and resistance $R_{22}=10^3\Omega$. The PFA tube 33 has excellent parting properties and even if toners adhere to its surface, they will readily peel off. This leads to the advantage that even if the transfer roller 28 is stained with the toners due to the unsatisfactory conveyance of the sheet 10, it will be possible to switch the polarity of the voltage source 32 to minus which is the same polarity as the charging polarity of the toner, thereby returning the toners onto the intermediate transfer roller 25 and collecting them onto the cleaner 11.

In the present embodiment, transfer is effected under very low resistance during primary transfer. Therefore the output voltage of the voltage source 31 is sufficient if it is 100 V or less. In regard to the voltage source 32 for the transfer roller 28, giving a transfer current to the resistance $R_3$ of the sheet 10 should only be taken into consideration, and about 500 V to 1000 V will suffice.

Table 2 below shows the result of a test carried out regarding the twining of the sheet 10 when varying the electrical resistivity ρ and resistances R of the intermediate transfer roller 25 and transfer roller 28.

TABLE 2 units: ρ[Ω · cm] R[Ω]

| | | $\rho_1$ | | | |
|---|---|---|---|---|---|
| | | $10^3$ | $10^4$ | $10^5$ | $10^6$ |
| | | $R_{21}$ | | | |
| $\rho_2$ | $R_{22}$ | $10^2$ | $10^3$ | $10^4$ | $10^5$ |
| $1.5\times10^5$ | $10^2$ | Δ | OK | OK | OK |
| $1.5\times10^6$ | $10^3$ | NG | Δ | OK | OK |
| $1.5\times10^7$ | $10^4$ | NG | NG | Δ | OK |
| $1.5\times10^8$ | $10^5$ | NG | NG | NG | Δ |

Δ shows that no problem arises under ordinary environment, but twining occurs to a sheet 10 left under a low humidity environment for a long period or during both-surface printing.

When the resistance $R_{22}$ of the transfer roller 28 is thus made smaller than the resistance $R_{21}$ of the intermediate transfer roller 25, the stable conveyance of the sheet 10 becomes possible. Further, when the intermediate transfer roller 25 and second transfer roller 28 of low resistance are used, any resistance fluctuation in the environment which would otherwise occur in a medium resistance area does not occur and source voltage control (such as ATVC method) conforming to the resistance values of the intermediate transfer roller 25 and transfer roller 28 becomes unnecessary. Also, a roller of low resistance can be produced more stably than a roller of medium resistance, and this leads to the fact that lower costs can be realized.

Figure 5:
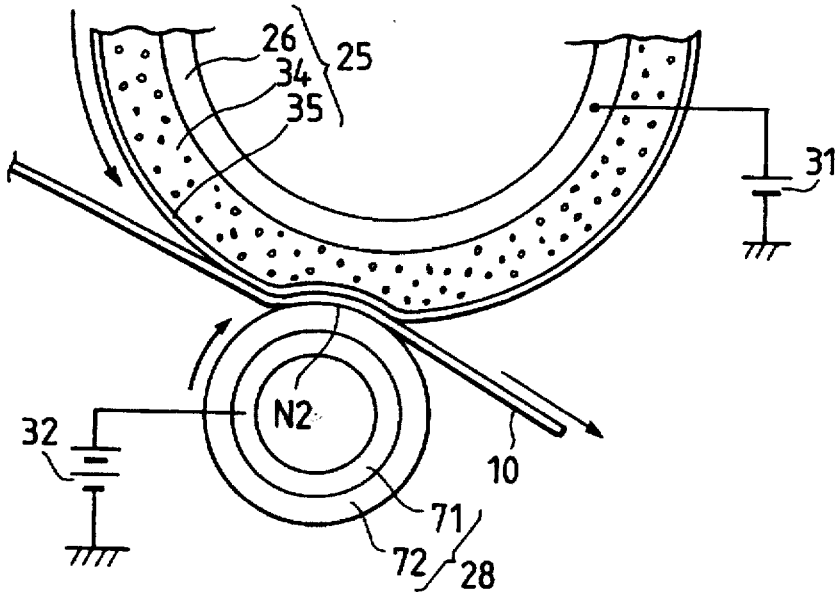
FIG. 5 is a model view of the essential portions of an image forming apparatus according to a fourth embodiment of the present invention.

<Fourth Embodiment> (FIG. 5)

FIG. 5 is a model view of the essential portions of an image forming apparatus according to a fourth embodiment of the present invention. This embodiment is similar to the first embodiment except for the apparatus construction and image forming operation which will hereinafter be described.

The feature of the present embodiment is that the intermediate transfer roller 25 is a roller of low hardness less than JIS A hardness 40 degrees or ASKER C hardness 60 degrees provided by forming on a mandrel 26 an elastic layer 34 of thickness 3 mm to 10 mm formed of a foamed material such as EPDM, chloroprene, or urethane having an electrical conductivity imparting material such as carbon, zinc oxide, tin oxide, or electrically conductive whisker dispersed therein, and forming on the uppermost layer 35 a thin surface layer 35 of thickness 5 to 30 μm formed of urethane, PFA, PVdF, or the like having an electrical conductivity imparting material also disposed therein.

As compared with the Young's modulus $5\times10^7N\cdot m^{-2}$ of the intermediate transfer roller shown in the example of the prior art, the Young's modulus converted value of the intermediate transfer roller 25 in the present embodiment is $2.3\times10^3N\cdot m^{-2}$ or less, and by its combination with the second transfer roller 28 of relatively high hardness, i.e., the transfer roller as shown in the example of the prior art wherein a solid-state elastic member 72 composed of urethane, silicone rubber, fluorine rubber or the like having an electrical conductivity imparting material dispersed therein is formed on the mandrel 71, the shape of the second transfer nip area N2 can be made concave toward the intermediate transfer roller 25 side, and the sheet 10 can be conveyed away from the intermediate transfer roller 25 against the electrostatic attraction.

Table 3 below shows the results of a test of the conveyability of the sheet 10 carried out with the hardnesses of the intermediate transfer roller 25 and transfer roller 28 made different from each other. Incidentally, in this test, transfer was executed at a transfer voltage of 500 to 1500 [V] with the resistance $R_{21}$ of the intermediate transfer roller 25 being $10^7$ to $10^8$ [Ω] and the resistance $R_{22}$ of the transfer roller 28 being $10^7$ to $10^8$ [Ω].

TABLE 3 unit: JIS A (parentheses indicate ASKER C corresponding values)

| hardness of transfer roller | hardness of intermediate transfer roller: 10 degrees (10) | 20 degrees (20) | 30 degrees (40) | 40 degrees (60) | 50 degrees (80) |
|---|---|---|---|---|---|
| 10 degrees (10) | Δ | NG | NG | NG | NG |
| 20 degrees (20) | OK | Δ | NG | NG | NG |
| 30 degrees (40) | OK | OK | Δ | NG | NG |
| 40 degrees (60) | OK | OK | OK | Δ | NG |
| 50 degrees (80) | OK | OK | OK | OK | Δ |

Δ shows that a sheet 10 of ordinary weight 75 to 135 gr/m$^2$ is OK, but a thin sheet 10 of weight 50 to 64 gr/m$^2$ sometimes causes twining.

By thus making the hardness of the intermediate transfer roller 25 equal to or less than 40 degrees (JIS A) and making the hardness of the second transfer roller 28 greater than the hardness of the intermediate transfer roller 25, the shape of the second transfer nip area N2 can be made concave toward the intermediate transfer roller 25 side and twining of the sheet 10 can be prevented by utilization of its rigidity. In the area wherein the hardness of the intermediate transfer roller 25 exceeds 40 degrees (JIS A), to make the shape of the second transfer nip area N2 concave toward the intermediate transfer roller 25, the urging force of the transfer roller 28 need be equal to or greater than 5000 gr weight, where rotational torque becomes great and smooth conveyance is difficult. Moreover, the urging force acting on the toners becomes great and a good transfer performance is not obtained.

Again in the present embodiment, as described with respect to the second embodiment, disposing the second transfer roller 28 upstream of the lowermost point of the intermediate transfer roller 25 and causing the sheet 10 to pass through the second transfer nip area N2 along the intermediate transfer roller 25 has been found to effectively stabilize conveyance of the sheet 10.

Figure 6:
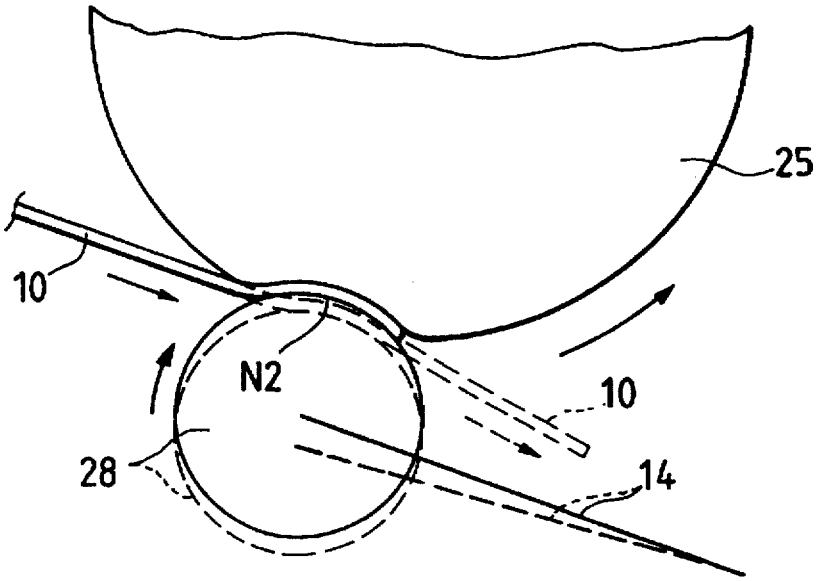
FIG. 6 is a model view of the essential portions of an image forming apparatus according to a fifth embodiment of the present invention.
Figure 7:
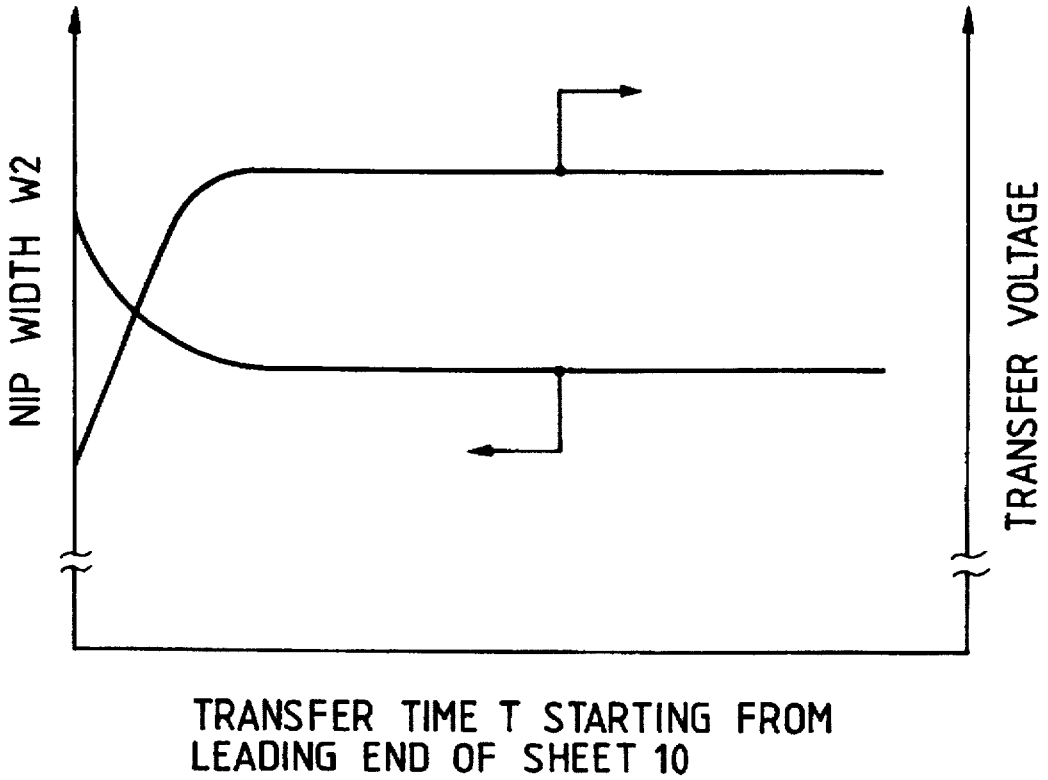
FIG. 7 is a graph showing variations with time in the nip width of the second transfer nip area and a transfer voltage.

<Fifth Embodiment> (FIGS. 6 and 7)

FIG. 6 is a model view of the essential portions of an image forming apparatus according to a fifth embodiment of the present invention. This embodiment is similar to the first embodiment except for the apparatus construction and image forming operation which will hereinafter be described.

The transfer roller 28 is designed such that, as in the fourth embodiment, by the combination thereof with the hardness of the intermediate transfer roller 25, the shape of the second transfer nip area N2 is concave toward the intermediate transfer roller 25. A feature of the present embodiment is that the amount of intrusion of the second transfer roller 28 into the intermediate transfer roller 25 is relatively large for the leading end portion of the sheet 10; the amount of intrusion is smaller for the succeeding portion of the sheet 10.

The amount of intrusion of the transfer roller 28 is controlled by switching the position of a transfer roller positioning lever 14. By doing so, the leading end portion of the sheet 10 can be easily separated from the intermediate transfer roller 25 and the pressure force applied to the succeeding portion of the sheet is decreased. Therefore the sheet 10 is not curled as a whole.

The broken lines of FIG. 6 indicate the positional relation between the sheet 10 in its succeeding portion and the transfer roller 28. Further, in the leading end portion the nip width becomes great and correspondingly thereto, the output voltage of the transfer voltage source 32 is made small. Control is effected so that the output voltage may become great in accordance with the fact that the nip width becomes small in the succeeding portion, whereby the transfer current can assume a predetermined value over the whole area of the sheet 10 to thereby stabilize the transfer performance more.

FIG. 7 shows the state of variations with time in the nip width $w_2$ and the transfer voltage at this time.

Figure 8:
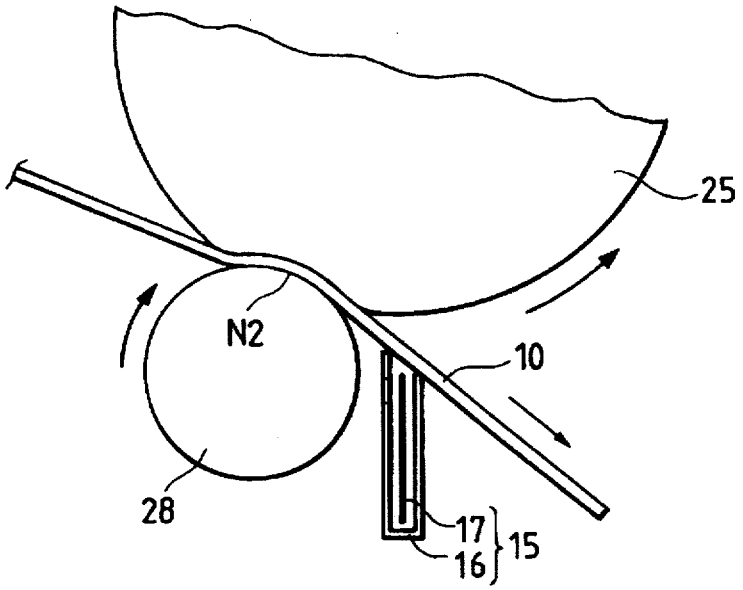
FIG. 8 is a model view of the essential portions of an image forming apparatus according to a sixth embodiment of the present invention.
Figure 9:
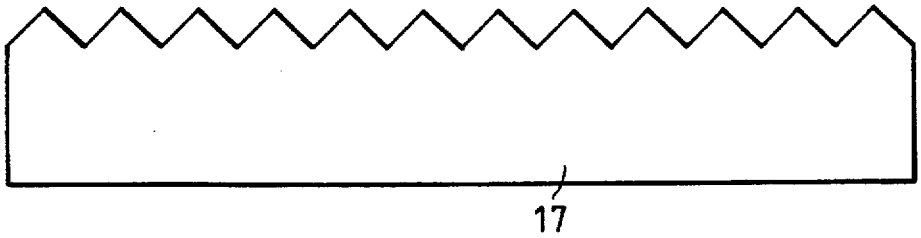
FIG. 9 is a plan view of a charge removing needle.
Figure 10:
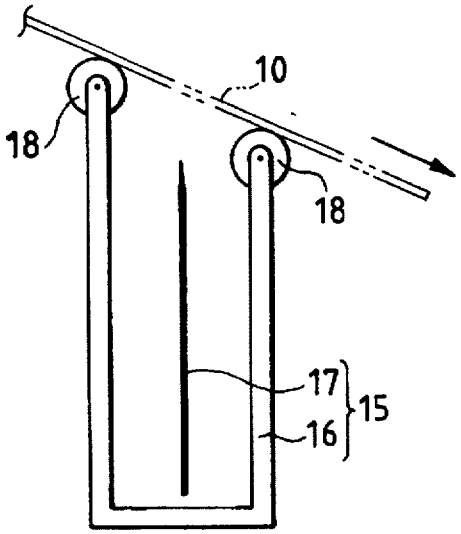
FIG. 10 is a side view of a modification of a charge removing needle holder.

<Sixth Embodiment> (FIGS. 8 to 10)

FIG. 8 is a model view of the essential portions of an imaging forming apparatus according to a sixth embodiment of the present invention. This embodiment is similar to the first embodiment except for the apparatus construction and image forming operation which will hereinafter be described.

The transfer roller 28 is designed such that, as in the fourth embodiment, by the combination thereof with the intermediate transfer roller 25, the shape of the second transfer nip area N2 is concave toward the intermediate transfer roller. The feature of the present embodiment is that a charge removing device 15 having a charge removing needle 17 formed of a thin metal sheet as shown in FIG. 9 and contained in a holder 16 formed of insulative resin such as polycarbonate, acryl or noryl is disposed downstream of the transfer roller 28 with respect to the direction of conveyance of the sheet. The 10 discharged from the nip which has been oriented by the direction of insertion of the sheet 10 into the second transfer nip area N2 and the shape of the nip is conveyed while being supported by the holder 16, thereby realizing a more stable conveyance of the sheet 10.

At a low process speed of the order of 50 mm/sec., the charge removing needle 17 is grounded, whereby the sheet 10 has its charges sufficiently removed. But at a medium to high process speed exceeding 100 mm/sec., a bias voltage opposite in polarity to the transfer voltage source 32 or an AC bias voltage is applied from a voltage source (not shown) to the charge removing needle 17, whereby charge removal can be effected more effectively and the disturbance of the toner images attributable to the charging caused by the contact between the holder 16 and the sheet 10 can be prevented.

To effect the conveyance of the sheet 10 stably, it is preferable that an opening in the holder 16 be 3 to 7 mm and the height of the upstream wall be made greater than the height of the downstream wall so that the leading end of the sheet 10 may not intrude into the opening. Also, as shown in FIG. 10, rotatable rollers 18 may be provided in the opening so as to mitigate the conveyance resistance of the sheet 10.

As described above, by the resistance value $R_{22}$ of the contact transfer member 28 being made smaller than the resistance value $R_{21}$ of the intermediate transfer member 25, the transfer of the image to the sheet 10 can be effectively performed and the twining of the sheet 10 around the intermediate transfer member 25 can be prevented.

Further, by the hardness of the contact transfer member 28 being made greater than that of the intermediate transfer member 25, the twining of the sheet 10 around the intermediate transfer member 25 can be prevented and stable conveyance of the sheet 10 can be realized.

Figure 13:
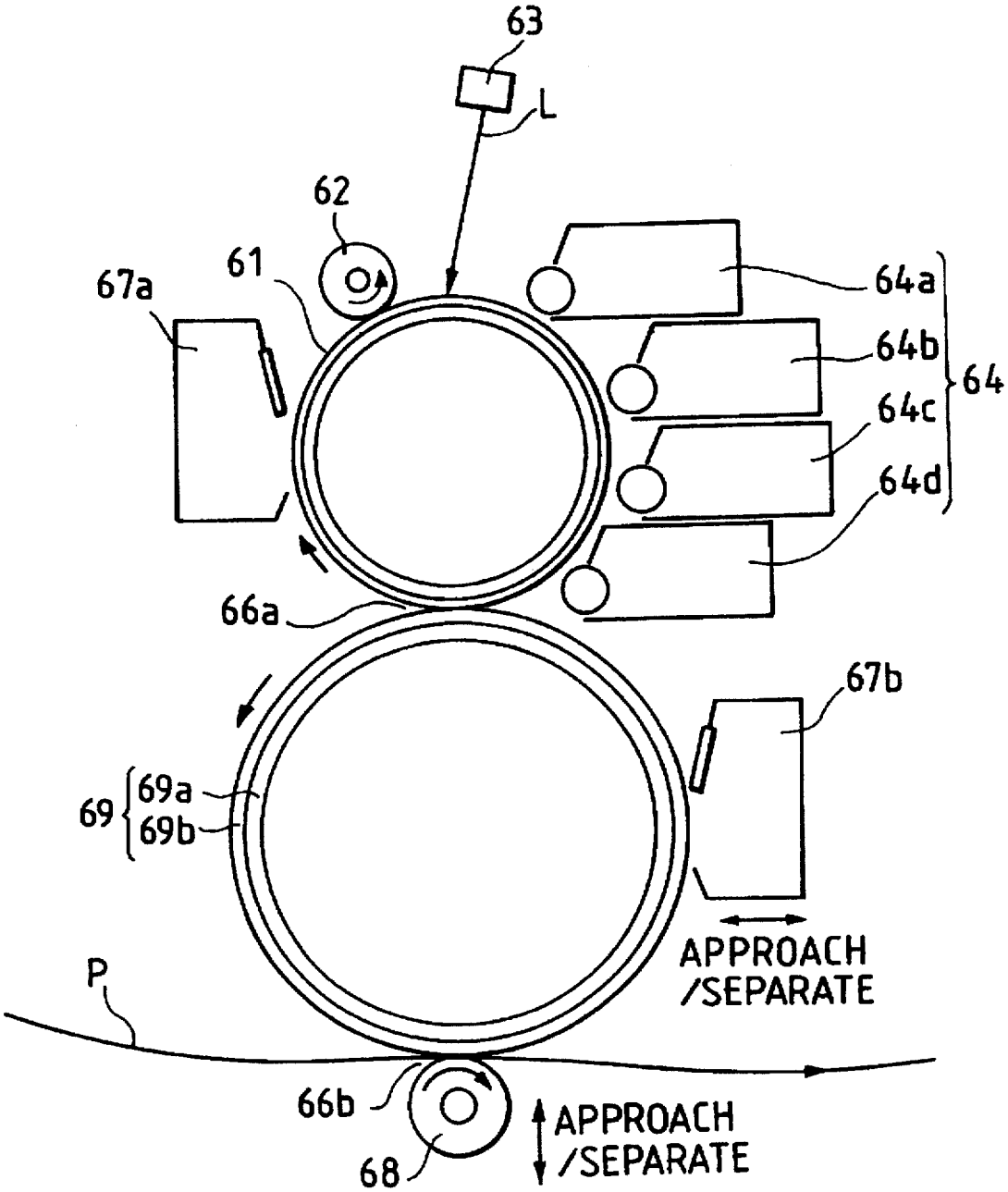
FIG. 13 schematically shows the construction of an image forming apparatus according to a seventh embodiment of the present invention.

<Seventh Embodiment> (FIGS. 13 and 14)

FIG. 13 schematically shows the construction of an image forming apparatus according to a seventh embodiment of the present invention.

The reference numeral 61 designates an electrophotographic photosensitive drum as an image bearing member having a photosensitive material such as OPC, amorphous Se, or amorphous Si formed on the outer peripheral surface of a cylinder-like base body of aluminum, nickel or like material. The photosensitive drum 61 is rotatively driven in the direction of the arrow and the surface thereof is first uniformly charged to −700 [V] as dark portion potential $V_D$ by a charging roller 62 as a charging device. Subsequently, by using a laser beam scanner 63 as exposure means, the photosensitive drum 61 is subjected to scanning exposure by a laser beam ON/OFF-controlled in conformity with first image information, whereby a first electrostatic latent image of −100 [V] as a light portion potential $V_L$ is formed on the photosensitive drum.

The thus formed electrostatic latent image is developed and visualized by a developing device 64. The developing device 64 is a compound device having a first developing device 64*a* containing therein yellow toner as a first color toner, a second developing device 64*b* containing therein magenta toner as a second color toner, a third developing device 64*c* containing therein cyan toner as a third color toner, and a fourth developing device 64*d* containing therein a black toner as a fourth color toner. The first electrostatic latent image is developed and visualized by the first developing device 64*a* containing therein the yellow toner as the first color toner. As the developing method, use is made of a jumping developing method, a two-component developing method, a FEED developing method or the like, and a combination of image exposure and reversal development is often used.

The visualized first toner image is electrostatically transferred (primary transfer) to the surface of an intermediate transfer member 69, in a first transfer region 66*a* opposed to the intermediate transfer member 69 as a second image bearing member rotatively driven.

The intermediate transfer member 69 has a circumferential length somewhat greater than the length of the sheet, and an elastic resistance layer 69*b* having electrically conductive particles dispersed in an elastic member and adjusted to a predetermined resistance value is formed on the outer peripheral surface of an electrically conductive mandrel 69*a*. This intermediate transfer member 69 is brought into pressure contact with the photosensitive drum 61 with a predetermined pressure force, and is rotatively driven in a forward direction relative to the direction of rotation of the photosensitive drum 61 at a predetermined peripheral speed.

The toner image formed on the surface of the photosensitive drum 61 as described above is electrostatically transferred (primary transfer) to the surface of the intermediate transfer member 69 by a voltage of polarity opposite the charging polarity of the toner, e.g. +1000 [V], applied to the mandrel 69*a* of the intermediate transfer member 69. Some amount of toner remaining on the surface of the photosensitive drum 61 after the primary transfer has been terminated is removed by a cleaning device 67*a*.

Subsequently, the above-described process is repeated three times, and each time the process is repeated, a second toner image developed by the magenta toner, a third toner image developed by the cyan toner and a fourth toner image developed by the black toner are superposed one upon another and primary-transferred to the surface of the intermediate transfer member 69. Thereby, a color image corresponding to desired color image information is compositely formed on the surface of the intermediate transfer member 69.

When the second toner image is to be primary-transferred to the surface of the intermediate transfer member 69, a voltage somewhat higher than the voltage applied to the mandrel 69*a* when the first toner image has been primary-transferred to the surface of the intermediate transfer member 69, e.g. +1500 [V], is applied. When the third toner image and the fourth toner image are to be likewise successively primary-transferred to the surface of the intermediate transfer member 69, the voltages applied to the mandrel 69*a* are successively made higher in a predetermined manner.

Thereafter, a transfer roller 68 (transfer means) kept spaced apart from the surface of the intermediate transfer member 69 is brought into pressure contact with the surface of the intermediate transfer member 69 with a predetermined pressure force and is rotated with the latter. A voltage of polarity opposite the charging polarity of the toners, e.g. +3000 [V] is applied from a voltage source (not shown) to the roller 68, whereby the layered toner images on the surface of the intermediate transfer member 69 are collectively transferred (secondary transfer) to the surface of a transfer material P conveyed to a second transfer region 66*b* at a predetermined timing. This transfer material P is conveyed to a fixing device, not shown, and the toner images are fixed as a permanent image, whereafter the transfer material P is discharged out of the apparatus.

Some amount of toner remaining on the surface of the intermediate transfer member 69 after the secondary transfer has been terminated is removed by a cleaning device 67*b* rendered operative to the surface of the intermediate transfer member 69 at predetermined timing.

Now, the results of experiments regarding the physical properties of the surface of the intermediate transfer member 69 carried out by the inventors is shown below and the effect of the present embodiment will hereinafter be described.

A. Hardness Experiment

First, the results of an experiment regarding the hardness of the surface of the intermediate transfer member is shown below. The constructions of the photosensitive drum 61, the intermediate transfer member 69, and the transfer roller 68 used in this experiment are shown in FIGS. 14A and 14B.

Figure 14A:
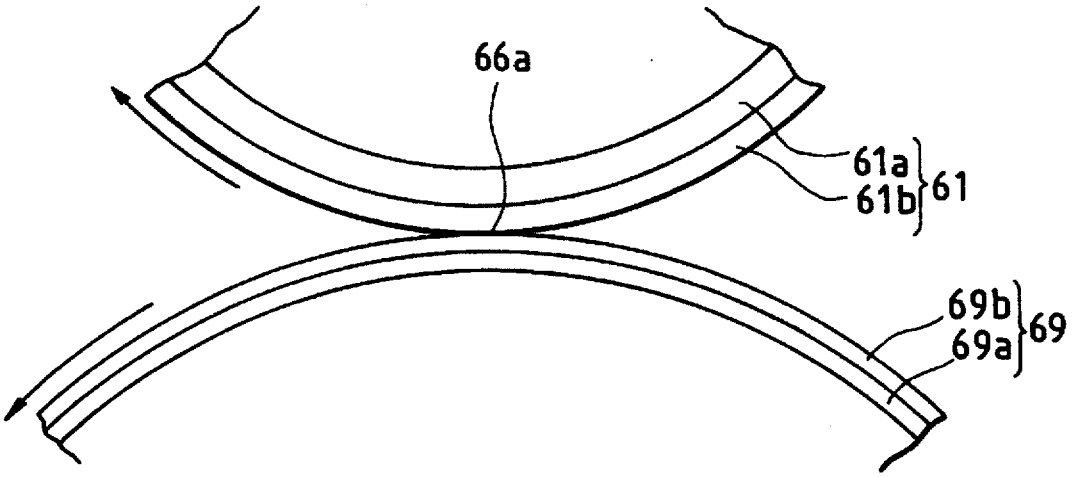
FIGS. 14A and 14B are enlarged views of first and second transfer regions, respectively.

In FIG. 14A, the photosensitive drum 61 has an organic photosensitive layer 61*b* with polycarbonate as a main binder formed on the outer peripheral surface of a cylinder-like base body 61*a* formed of grounded aluminum of thickness 1 [mm], and the outer diameter thereof is 30 [mm]. The intermediate transfer member 69 has an elastic resistance layer 69*b* of thickness 5 mm whose resistance value is controlled to $10^8$ to $10^9$ [Ω] by carbon as electrically conductive particles being dispersed in silicone rubber, and formed on the outer peripheral surface of a cylinder-like base body 69*a* formed of aluminum of thickness 3 [mm] where the outer diameter thereof is 150 [mm]. The photosensitive drum 61 and the intermediate transfer member 69 are urged against each other by pressing means (not shown) with total pressure of 500 [g].

Figure 14B:
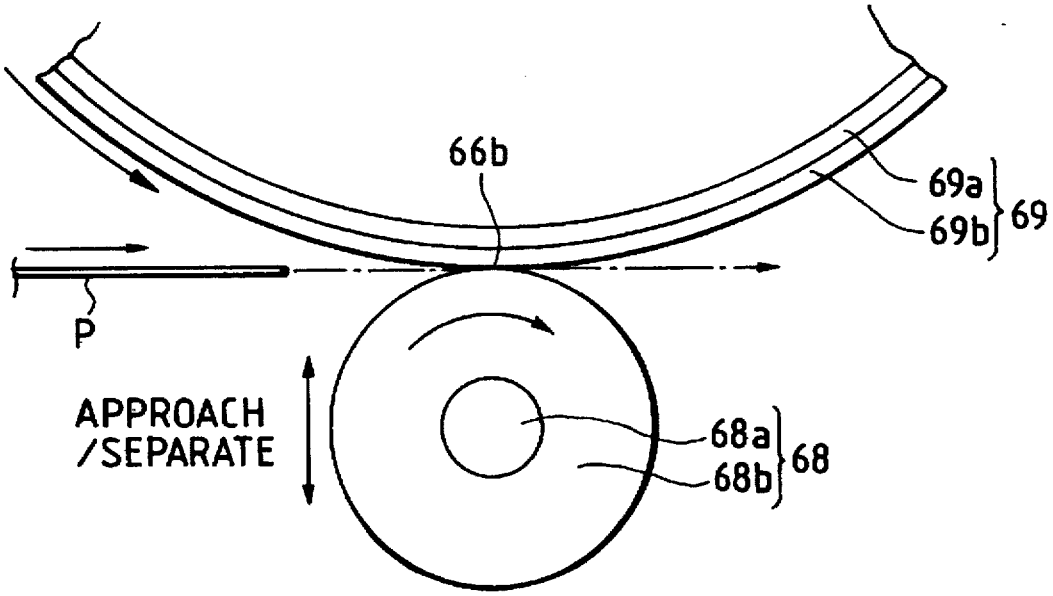

In FIG. 14B, the transfer roller 68 has foamed EPDM as an electrically conductive elastic layer 68a having carbon as electrically conductive particles dispersed therein which is formed on a mandrel 68a formed of iron and having an outer diameter 6 [mm], the outer diameter thereof is 20 [mm] and the hardness thereof is 45° (ASKER C). The transfer roller 68 is urged against the surface of the intermediate transfer member 69 by pressing means, not shown, at predetermined timing and with total pressure of 800 [g].

In the present experiment, by preparing the composition of silicone rubber forming the elastic resistance layer 69b, five kinds of intermediate transfer members differing in hardness were successively incorporated into the aforedescribed image forming apparatus, and transfer efficiency T (61→69) when the toner image was primary-transferred from the surface of the photosensitive drum 61 to the surface of the intermediate transfer member 69 in each case efficiency T(69→P) when the toner image was secondary-transferred from the surface of the intermediate transfer member 69 to the surface of paper as the transfer material P also was measured.

The present experiment was carried out with a monochromatic image of the black toner alone, and reflection density $D_1$ was measured for a solid black image of 5 [mm] square that was formed on the surface of the photosensive drum 61. The image was transcribed onto the surface of white paper by means of a transparent adhesive paper. Reflection density $D_2$ was measured when a solid black image of 5 [mm] square was formed on the surface of the intermediate transfer member by the solid black image of 5 [mm] square being primary-transferred to the surface of the intermediate transfer member 69 and was transcribed onto the surface of white paper by means of a transparent adhesive tape. The reflection density $D_3$ of a solid black image of 5 [mm] square formed on the surface of paper by the solid black image of 5 [mm] square being secondary-transferred to the surface of the paper was measured. The transfer efficiency T(61→69) and the transfer efficiency T(69→P) were defined by the following calculation expressions:

$$T(61\rightarrow 69)=D_2/D_1\times 100$$

$$T(69\rightarrow P)=D_3/D_2\times 100$$

Table 4 below shows the relations between the hardness of the intermediate transfer member 69 and the transfer efficiency, where T(61→P) represents the final transfer efficiency calculated from the product of the transfer efficiency T(61→69) and the transfer efficiency T(69→P).

TABLE 4

| Hardness | 30° | 40° | 50° | 60° | 70° |
|---|---|---|---|---|---|
| T (61 → 69) | 87% | 81% | 72% | 51% | 33% |
| T (69 → P) | 93% | 94% | 93% | 95% | 97% |
| T (61 → P) | 81% | 76% | 67% | 48% | 32% |

According to the above table, regarding the secondary transfer efficiency T(69→P), there is very little influence of the hardness of the intermediate transfer member 69 because the transfer roller 68 is formed of soft foamed sponge. However regarding the primary transfer efficiency T(61→69), the influence of the hardness of the intermediate transfer member 69 is very great and the primary transfer efficiency T(61→69) tends to increase as the hardness becomes greater. According to the inventors' experiment, it is seen that to obtain a good final output image it is preferable that the final transfer efficiency T(61→P) be 80% or greater and that it is only when the hardness of the intermediate transfer member 69 is 30° that this condition is satisfied.

B. Parting or Demolding Property Experiment

On the basis of the foregoing result, an experiment regarding the parting property of the surface of the intermediate transfer member 69 was carried out with a view to improve the primary transfer efficiency T(61→69) which is greatly affected by the hardness of the intermediate transfer member 69. In this experiment, materials differing from the above-mentioned silicone rubber, (i) a teflon tape of thickness 10 μm coating the outer peripheral surface of said silicone rubber, and (ii) an intermediate transfer member 69 having an elastic resistance layer 69b formed of urethane rubber were successively incorporated into the aforedescribed image forming apparatus, and the primary transfer efficiency T(61→69), the secondary transfer efficiency T(69→P) and the final transfer efficiency T(61→P) in each case were measured. Like the aforedescribed experiment, this experiment was carried out on a monochromatic image of the black toner alone.

Table 5 below shows the relationship between the hardness of the intermediate transfer member and the transfer efficiency when an intermediate transfer member 69 having an elastic resistance layer having its outer peripheral surface of silicone rubber coated with a teflon tape of thickness 10 μm was used, and Table 6 below shows the relationship between the hardness of the intermediate transfer member and the transfer efficiency when an intermediate transfer member 69 having an elastic resistance layer 69b formed of urethane rubber was used.

TABLE 5

| Hardness | 30° | 40° | 50° | 60° | 70° |
|---|---|---|---|---|---|
| T (61 → 69) | 72% | 66% | 53% | 42% | 31% |
| T (69 → P) | 96% | 95% | 95% | 96% | 96% |
| T (61 → P) | 69% | 63% | 50% | 40% | 30% |

TABLE 6

| Hardness | 30° | 40° | 50° | 60° | 70° |
|---|---|---|---|---|---|
| T (61 → 69) | 95% | 89% | 82% | 72% | 58% |
| T (69 → P) | 97% | 96% | 96% | 97% | 97% |
| T (61 → P) | 92% | 85% | 79% | 70% | 56% |

According to these tables, it is seen that when an intermediate transfer member has its outer periphery of silicone rubber coated with a teflon tape, the transfer efficiency is more higher than in the case of a single layer of silicone rubber and that when an intermediate transfer member formed of urethane rubber is used, if the hardness thereof is 50° or less, preferably 40° or less, there is obtained a final transfer efficiency T(61→P) which will pose little or no problem in practical use.

It is believed that the parting property of the surface of the intermediate transfer member is greatly concerned in this and therefore, the angles of contact of the above-mentioned materials with water were measured by the well-known liquid drop method. As a result, the hardness of the surface of the photosensitive drum formed of polycarbonate was 84°. The hardnesses of the surface of the intermediate transfer roller formed of silicone rubber, the surface of the intermediate transfer roller having its outer periphery of silicone rubber coated with a teflon tape, and the surface of the intermediate transfer roller formed of urethane rubber were 103°, 114°, and 77°, respectively.

According to this, it will become possible to accomplish good transfer if the angle of contact of the surface of the intermediate transfer member 69 with water is smaller than the angle of contact of the surface of the photosensitive drum 61 with water. In other words, if the parting property of the photosensitive drum 61 is better than the parting property of the surface of the intermediate transfer member 69.

If the hardness of the intermediate transfer member 69 is too low, the deformation of the intermediate transfer member 69 by the pressure contact of the photosensitive drum 61 and transfer roller 68 therewith in the first transfer region 66*a* and the second transfer region 66*b* will become great, whereby in the formation of a color image, image misregistration is liable to occur to the toner images of four colors. Therefore the hardness of the intermediate transfer roller 69 should be 10° or greater, preferably 20° or greater.

In view of the foregoing, in the present embodiment, an intermediate transfer member 69 having an elastic resistance layer 69*b* of thickness 5 mm having electrically conductive carbon particles dispersed in urethane rubber and having its resistance value controlled between $10^8$ to $10^9$ [Ω] was added. Layer 69*b* was formed on the outer peripheral surface of a cylinder-like base body 69*a* formed of aluminum of thickness 3 [mm], the hardness of the surface of the intermediate transfer member 69 was selected to be 40° or less and the angle of contact of the surface of the intermediate transfer member 69 with water was set to an angle smaller than the angle of contact of the surface of the photosensitive drum 61 with water, and the parting property of the surface of the photosensitive drum 61 was made better than the parting property of the surface of the intermediate transfer member 69. Thus, toner images of four colors were successively primary-transferred from the photosensitive drum 61 to the surface of the intermediate transfer member 69, and when these images were collectively secondary-transferred onto the transfer material P, it became possible to obtain a good color image free of defects such as image break and color irregularity.

In the present embodiment, OPC having an organic photosensitive layer 61*b* was used as the photosensitive drum 61 and an intermediate transfer member comprising a single layer 69*b* of urethane rubber was used as the intermediate transfer member. These materials are not restrictive as long as the hardness of the surface of the intermediate transfer member 69 and the angles of contact of the surface of the photosensitive drum 61 and the surface of the intermediate transfer member 69 with water satisfy the above-described conditions. Of course, an amorphous silicon drum may be used as the photosensitive drum 61, and an intermediate transfer member having a single layer of chroloprene rubber or NBR rubber or an intermediate transfer member of two-layer construction having a thin layer formed on the outer peripheral surface of said single layer may be used as the intermediate transfer member 69.

Figure 15:
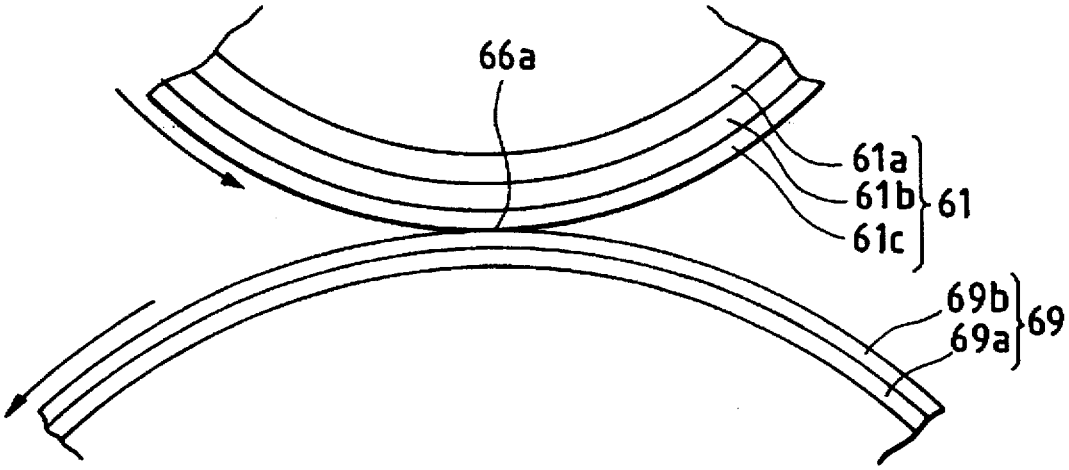
FIG. 15 is an enlarged view of a first transfer region of an image forming apparatus according to an eighth embodiment of the present invention.

<Eighth Embodiment> (FIG. 15)

This embodiment is characterized in that a photosensitive drum having a surface protecting layer 61*c* formed on an organic photosensitive layer 61*b*, as shown in FIG. 15, is used as the photosensitive drum 61. The purpose of this is to prevent the transfer efficiency T(61→69) when toner images are primary-transferred from the surface of the photosensitive drum 61 to the surface of the intermediate transfer member 69 from decreasing, in view of the general tendency that the parting property of the surface of the photosensitive drum is gradually aggravated by the long-period use of the image forming apparatus.

The photosensitive drum 61 shown in the present embodiment is provided by forming an organic photosensitive layer 61*b* of a predetermined film thickness on the outer peripheral surface of a base body 61*a* by dipping and drying it, and thereafter forming a surface protecting layer 61*c* to a predetermined film thickness on the outer peripheral surface thereof as by spraying.

Preferably the material of the surface protecting layer 61*c* is resin having a light transmittance of 80% or greater, such as polyester, acryl, polyvinyl carbazole, phenoxy, polyvinyl butyral, polystyrene, polyvinyl acetate, polysulfone, polyarilate, vinylidene chloride-acrylonitrile copolymer, or polycarbonate. In order to maintain the photosensitive characteristic of the photosensitive drum 61, a charge transporting material such as a hydrazone compound, a pyrazoline compound, a triaryl amine compound, a stilbene compound, an oxazole compound, a thiazole compound or a triaryl methane compound may be dispersed in said resin. This surface protecting layer 61*c* is not in direct contact with a charge generating layer and therefore, by dispersing an additive therein, it is possible to give various functions to the surface protecting layer without greatly spoiling the photosensitive characteristic.

So, in the present embodiment, polycarbonate resin was used as the surface protecting layer 61*c* and teflon (trademark, tetrafluoroethylene resin) particles of particle diameter 0.5 μm were dispersed in it at 30% by weight, whereby the angle of contact of the surface of the photosensitive drum with water which greatly affects the primary transfer of toner images from the surface of the photosensitive drum 61 to the surface of the intermediate transfer member 69 was set to an angle greater than in the seventh embodiment.

Specifically, the angle of contact of the surface of the photosensitive drum in the seventh embodiment with water was 84° as previously described, whereas the angle of contact of the surface of the photosensitive drum 61 coated with the surface protecting layer having teflon particles dispersed therein as shown in the present embodiment with water was 109°.

As the amount of teflon to be added, 60% by weight may preferably be the maximum in order to maintain the conventional photosensitive characteristic sufficiently.

Thus constructed photosensitive drum 61 was mounted in the image forming apparatus shown in the seventh embodiment and 5,000 sheets of full color images were outputted, and when the angle of contact of the surface of the photosensitive drum 61 with water was then measured, it was 96°. The parting property of this photosensitive drum was somewhat inferior to that in the initial state, but this angle of contact was greater than the angle of contact 68° of the intermediate transfer member 69 formed of urethane rubber with water at the same point of time, and the color images outputted were free of defects such as image break and color irregularity.

Also, the photosensitive drum 61 having the surface protecting layer 61*c* as shown in the present embodiment has the following advantage when it is used in combination with a contact charging device like a charging roller 62. In recent years, from the viewpoint of the downsizing of the apparatus, the mitigation of the amount of ozone produced, etc., contact charging devices like the above-described charging roller 62 have come to be widely used. However if a minute break like a pin-hole should be present in the surface of the photosensitive drum, there has been a case where unsatisfactory charging occurs due to the bias applied to the charging roller 62 leaking when the charging roller 62 contacts the minute break. However, by covering the surface of the photosensitive drum with the surface protecting layer 61c, the charging roller will not directly contact the pin-hole and thus, it becomes possible to prevent the occurrence of unsatisfactory charging.

Figure 16:
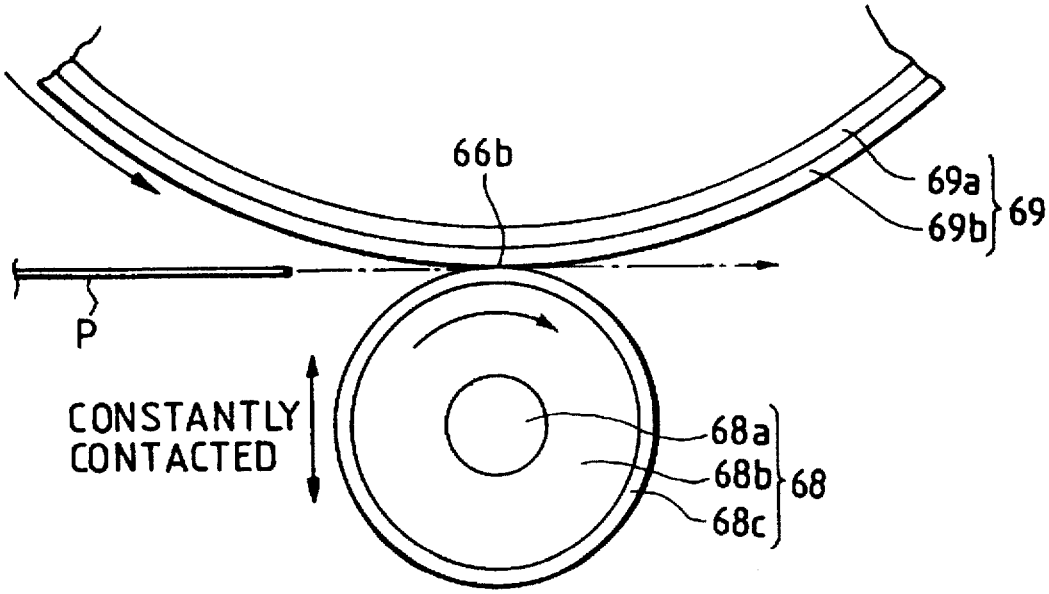
FIG. 16 is an enlarged view of a second transfer region of an image forming apparatus according to a ninth embodiment of the present invention.

<Ninth Embodiment> (FIG. 16)

This embodiment is characterized in that the photosensitive drum 61 and the intermediate transfer member 69 are made similar to those in the seventh and eighth embodiments, but the layer construction of the transfer roller 68 is made different and the mechanism for bringing the transfer roller 68 into contact with and away from the surface of the intermediate transfer member 69 is eliminated so that the transfer roller 68 is always in contact with the surface of the intermediate transfer roller 69.

In the image forming apparatus as shown in the seventh embodiment, in the process wherein layered images of respective colors (layered toner images) are formed on the surface of the intermediate transfer member 69, the above-described mechanism for bringing the transfer roller 68 into contact with and away from the surface of the intermediate transfer member 69 has been necessary to prevent those images from adhering to the surface of the transfer roller 68 formed of foamed sponge, and bring the transfer roller 68 into contact with the surface of the intermediate transfer member 69 only when said layered images are secondary-transferred to the surface of the transfer material P. This, however, leads to complication of apparatus construction and causes the bulkiness of the apparatus. In order to increase the throughput of the transfer material P, it is preferable that the layered toner image of the fourth color be primary-transferred from the surface of the photosensitive drum 61 to the surface of the intermediate transfer member 69 and yet the layered toner images comprising four layers be secondary-transferred in succession to the surface of the transfer material P and therefore, there has been a case where the vibration when the transfer roller 68 contacts the surface of the intermediate transfer member 69 causes a blur of the toner image of the fourth color, thus remarkably deteriorating the quality of image.

So, in the present embodiment, a parting property layer is provided on the surface of the transfer roller 68 to thereby make the parting property of the transfer roller better than the parting property of the surface of the intermediate transfer member 69, whereby it is made possible to prevent said layered images from shifting to the surface of the transfer roller even if the transfer roller 68 is always brought into contact with the surface of the intermediate transfer member 69.

FIG. 16 shows the layer construction of the transfer roller 68 according to the present embodiment, where the mandrel 68a and the electrically conductive elastic layer 68b are similar to those shown in the seventh embodiment. The outer peripheral surface of the electrically conductive elastic layer 68b is coated with an insulative PFA layer 68c of thickness 5 μm as a parting property layer.

The angle of contact of the surface of this transfer roller 68 with water is 99°, which is greater than the angle of contact of the surface of the intermediate transfer member 69 formed of urethane rubber with water. Therefore, even if these are always in contact with each other, the toner images on the surface of the intermediate transfer member 69 can be prevented from shifting to the surface of the transfer roller 68. Also, since this transfer roller 68 has its surface coated with the insulative PFA layer 68c as a parting property layer, the bias applied to the mandrel 69a of the intermediate transfer member 69 can be prevented from leaking through the transfer roller 68 even when the toner images on the surface of the photosensitive drum 61 are primary-transferred to the surface of the intermediate transfer member 69. Thus the primary transfer efficiency T(61→69) is not aggravated.

Figure 17:
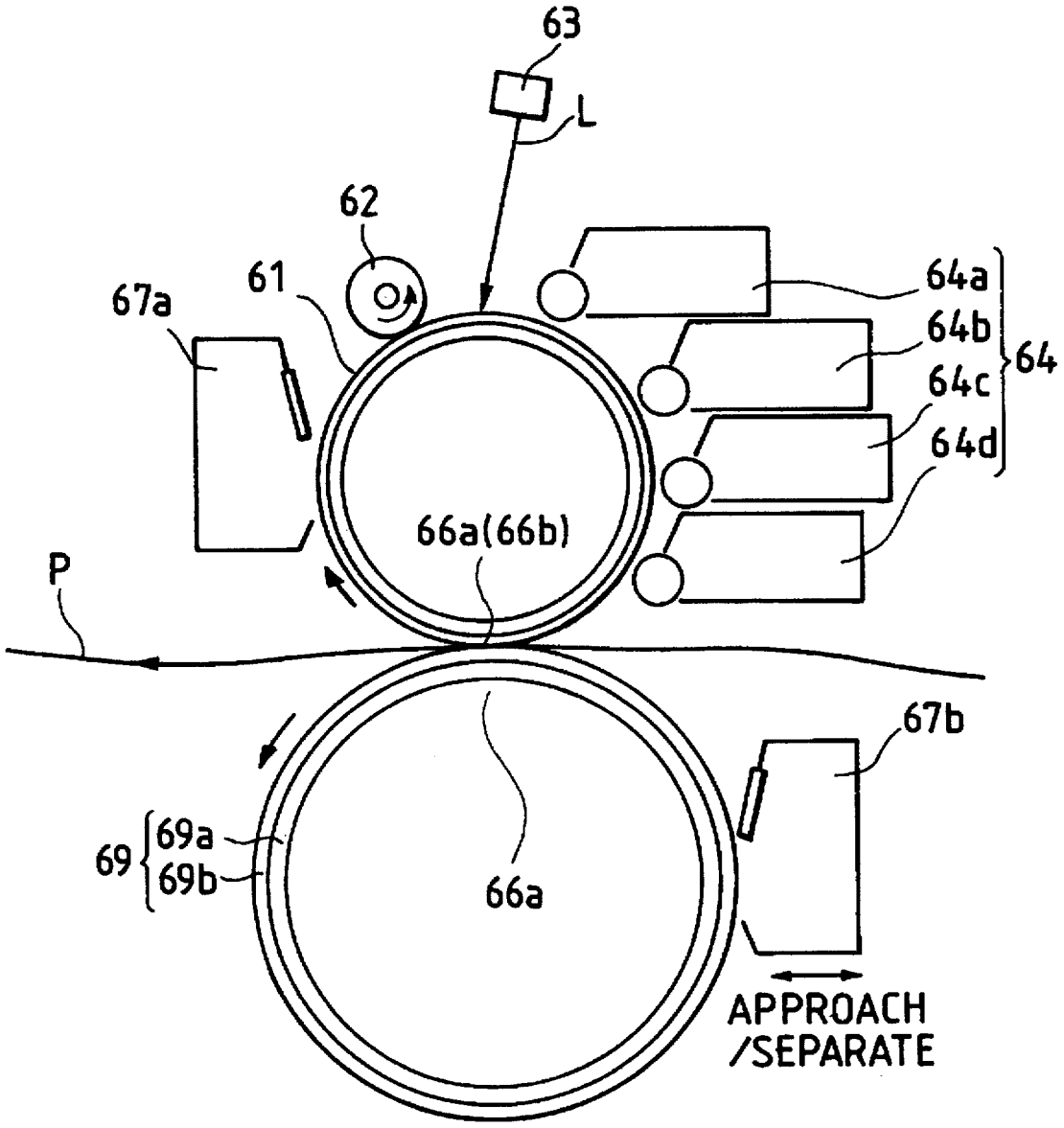
FIG. 17 schematically shows the construction of an image forming apparatus according to a tenth embodiment of the present invention.

<Tenth Embodiment> (FIG. 17)

This embodiment is an image forming apparatus in which the toner images are secondary-transferred from the intermediate transfer member 69 to the transfer material P without the intermediary of the transfer roller 68 as shown in the previous embodiment. The image forming apparatus of the present embodiment is shown in FIG. 17 wherein the same members as those in the apparatus of the seventh embodiment shown in FIG. 13 are given the same reference characters.

The color image forming process in this image forming apparatus is similar to that in the seventh embodiment up to the stage at which the layered images of the four toner colors are formed on the surface of the intermediate transfer member 69. However, when the layered images are to be secondary-transferred to the surface of the transfer material P, the transfer material P may be conveyed to a first transfer region 66a formed by and between the photosensitive drum 61 and the intermediate transfer member 69. Electrostatic transfer may be effected in the first transfer region 66a without the use of a transfer roller, i.e., by the photosensitive drum 61 being caused to function as a transfer roller, and this leads to the possibility of making the apparatus compact.

For example, a surface protecting layer 61c having teflon particles dispersed in polycarbonate resin is formed on the surface of the photosensitive drum 61, as shown in FIG. 15, and the surface of the intermediate transfer member 69 is made into an elastic resistance layer 69b having carbon dispersed in urethane rubber, whereby it becomes possible to efficiently effect the primary transfer of the toner images formed on the surface of the photosensitive drum 61 to the surface of the intermediate transfer member 69.

The seventh to tenth embodiments can be suitably combined with the first to sixth embodiments.

As described above, in an image forming apparatus using the intermediate transfer member, the overall transfer efficiency of primary transfer and secondary transfer can be improved and it is possible to obtain a final output image of high density and good quality free of partial image break and defects such as color irregularity and image misregistration in color image formation.

As the process of forming images on the image bearing member, use can be made of not only the above-described electrophotographic process but also an electrostatic recording process, a magnetic recording process or the like. The intermediate transfer member is not limited to a drum-shaped one, but may be a belt-shaped one. The sheet is not limited to paper, but may be printing paper, a card, an envelope, a postcard, or the like.

The present invention is not restricted to the above-described embodiments all modifications within the scope of the technical idea of the present invention are possible.

What is claimed is:

1. An image forming apparatus comprising:

an image bearing member for bearing an image thereon;

an intermediate transfer member having a base body and an elastic member provided outside said base body and onto which an image is transferrable from said image bearing member; and a second transfer member forming a nip portion between said second transfer member and said intermediate transfer member for transferring an image from said intermediate transfer member to a transfer material in said nip portion, wherein a hardness of the surface of said second transfer member is greater than a hardness of the surface of said intermediate transfer member, and an angle of contact of the surface of said intermediate transfer member with water is small than an angle of contact of the surface of said image bearing member with water.

2. An image forming apparatus according to claim 1, wherein said image bearing member has a photosensitive layer and a protective layer covering said photosensitive layer.

3. An image forming apparatus according to claim 1, wherein the angle of contact of the surface of said second transfer member with water is greater than the angle of contact of the surface of said intermediate transfer member with water.

4. An image forming apparatus according to claim 1, wherein images of a plurality of colors are superimposedly transferred successively from said image bearing member to said intermediate transfer member, whereafter the images of said plurality of colors are collectively transferred from said intermediate transfer member to said transfer material.

5. An image forming apparatus according to claim 1, wherein said intermediate transfer member is drum-shaped.

6. An image forming apparatus according to claim 1 or 5, wherein said second transfer member is a roller.

7. An image forming apparatus comprising:

an image bearing member for bearing an image thereon;

an intermediate transfer member having a base body and an elastic member provided outside said base body and onto which an image is transferrable from said image bearing member; and a second transfer member forming a nip portion between said second transfer member and said intermediate transfer member for transferring an image from said intermediate transfer member to a transfer material in said nip portion, wherein a hardness of the surface of said second transfer member is greater than a hardness of the surface of said intermediate transfer member, and wherein the hardness of the surface of said intermediate transfer member is 40° (JIS A) or less.

8. An image forming apparatus according to claim 7, wherein an angle of contact of the surface of said intermediate transfer member with water is smaller than an angle of contact of the surface of said image bearing member with water.

9. An image forming apparatus comprising:

an image bearing member for bearing an image thereon;

an intermediate transfer member having a base body and an elastic member provided outside said base body and onto which an image is transferrable from said image bearing member; and a second transfer member forming a nip portion between said second transfer member and said intermediate transfer member for transferring an image from said intermediate transfer member to a transfer material in said nip portion, wherein a hardness of the surface of said second transfer member is greater than a hardness of the surface of said intermediate transfer member, and wherein a pressure force of said second transfer member against said intermediate transfer member is greater when a leading end portion of said transfer material is in said nip portion than when a remaining portion of said transfer material is in said nip portion.

10. An image forming apparatus comprising:

an image bearing member for bearing an image thereon;

an intermediate transfer member having a base body and an elastic member provided outside said base body and onto which an image is transferrable from said image bearing member; and a second transfer member forming a nip portion between said second transfer member and said intermediate transfer member for transferring an image from said intermediate transfer member to a transfer material in said nip portion, wherein a hardness of the surface of said second transfer member is greater than a hardness of the surface of said intermediate transfer member, and wherein said second transfer member electrostatically transfers the image from said intermediate transfer member to said transfer material, and a resistance of said second transfer member is smaller than a resistance of said intermediate transfer member.

11. An image forming apparatus according to claim 10, wherein the resistance of said second transfer member is smaller than $10^6\Omega$.

12. An image forming apparatus according to claim 11, wherein the resistance of said intermediate transfer member is $10^6$ to $10^9\Omega$.

13. An image forming apparatus according to claim 10, wherein the resistance of said intermediate transfer member is ten or more times as great as the resistance of said second transfer member.

14. An image forming apparatus comprising:

an image bearing member for bearing an image thereon;

an intermediate transfer member having a base body and an elastic member provided outside said base body and onto which an image is transferrable from said image bearing member; and a second transfer member forming a nip portion between said second transfer member and said intermediate transfer member for transferring an image from said intermediate transfer member to a transfer material in said nip portion, wherein a hardness of the surface of said second transfer member is greater than a hardness of the surface of said intermediate transfer member, and wherein said second transfer member electrostatically transfers said image from said intermediate transfer member to said transfer material.

15. An image forming apparatus comprising:

an image bearing member for bearing an image thereon; and an intermediate transfer member onto which an image is transferrable from said image bearing member and which transfers the image to a transfer material, an angle of contact of the surface of said intermediate transfer member with water being smaller than an angle of contact of the surface of said image bearing member with water.

16. An image forming apparatus according to claim 15, wherein a hardness of the surface of said intermediate transfer member is 40° (JIS A) or less.

17. An image forming apparatus according to claim 15, further comprising a second transfer member for electrostatically transferring the image from said intermediate transfer member to said transfer material, said second transfer member effecting image transfer in a nip portion formed between said intermediate transfer member and said second transfer member, a resistance of said second transfer member being smaller than a resistance of said intermediate transfer member.

18. An image forming apparatus according to claim 17, wherein a resistance of said second transfer member is smaller than $10^6\Omega$.

19. An image forming apparatus according to claim 18, wherein the resistance of said intermediate transfer member is $10^6$ to $10^9\Omega$.

20. An image forming apparatus according to claim 17, wherein the resistance of said intermediate transfer member is ten or more times as great as the resistance of said second transfer member.

21. An image forming apparatus according to claim 15, wherein said image bearing member has a photosensitive layer and a protective layer covering said photosensitive layer.

22. An image forming apparatus according to claim 15, further comprising a second transfer member for transferring said image from said intermediate transfer member to said transfer material, an angle of contact of the surface of said second transfer member with water being greater than an angle of contact of the surface of said intermediate transfer member with water.

23. An image forming apparatus according to claim 15, wherein images of a plurality of colors are superimposedly transferred successively from said image bearing member to said intermediate transfer member, whereafter the images of said plurality of colors are collectively transferred from said intermediate transfer member to said transfer material.

24. An image forming apparatus according to claim 15, wherein said intermediate transfer member is drum-shaped.

25. An image forming apparatus according to claim 15 or 24, further comprising a second transfer member for transferring said image from said intermediate transfer member to said transfer material, said second transfer member being a roller.

26. An image forming apparatus according to claim 15, wherein a nip portion is formed between said image bearing member and said intermediate transfer member, and image transfer from said intermediate transfer member to said transfer material is effected at said nip portion.

27. An image forming apparatus comprising:

an electrophotographic photosensitive body for bearing an image thereon;

an intermediate transfer member onto which an image is transferrable from said electrophotographic photosensitive body; and a second transfer roller forming a nip portion between said second transfer roller and said intermediate transfer member for electrostatically transferring an image from said intermediate transfer member to a transfer material in said nip portion, a resistance of said second transfer roller being smaller than a resistance of said intermediate transfer member and smaller than $10^6\Omega$, wherein a hardness of surface of said intermediate transfer member is 40° (JIS A) or less.

28. An image forming apparatus comprising:

an electrophotographic photosensitive body for bearing an image thereon;

an intermediate transfer member onto which an image is transferrable from said electrophotographic photosensitive body; and a second transfer roller forming a nip portion between said second transfer roller and said intermediate transfer member for electrostatically transferring an image from said intermediate transfer member to a transfer material in said nip portion, a resistance of said second transfer roller being smaller than a resistance of said intermediate transfer member and smaller than $10^6\Omega$, wherein the resistance of said intermediate transfer member is ten or more times as great as the resistance of said second transfer roller.

* * * * *

UNITED STATES PATENT AND TRADEMARK OFFICE

CERTIFICATE OF CORRECTION

PATENT NO. : 5,732,314

DATED : March 24, 1998

INVENTOR(S) : TSUKIDA ET AL.

It is certified that error appears in the above-indentified patent and that said Letters Patent is hereby corrected as shown below:

Column 1

Line 60, "roller" should read --roller 5--.

Column 9

Line 5, "With" should read --with--.
Line 18, "seocnd;" should read --second--.
Line 41, "Therefore" should read --Therefore,--.
Line 67, "Therefore" should read --Therefore,--.

Column 15

Line 17, "case" should read --case were measured. Transfer--.
Line 62, "However" should read --However,--.

Column 17

Line 16, "Therefore" should read --Therefore,--.

Column 18

Line 63, "However" should read --However,--.

UNITED STATES PATENT AND TRADEMARK OFFICE

CERTIFICATE OF CORRECTION

PATENT NO. : 5,732,314 Page 2 of 2

DATED : March 24, 1998

INVENTOR(S) : TSUKIDA ET AL.

It is certified that error appears in the above-indentified patent and that said Letters Patent is hereby corrected as shown below:

Column 20

Line 1, "the" (second occurrence) should be deleted.
Line 55, "embodiments" should read --embodiments;--.

Signed and Sealed this

Twenty-seventh Day of October, 1998

*Attest:*

Bruce Lehman

BRUCE LEHMAN

*Attesting Officer*

*Commissioner of Patents and Trademarks*